US011094312B2

(12) United States Patent
Daido

(10) Patent No.: US 11,094,312 B2
(45) Date of Patent: Aug. 17, 2021

(54) VOICE SYNTHESIS METHOD, VOICE SYNTHESIS APPARATUS, AND RECORDING MEDIUM

(71) Applicant: YAMAHA CORPORATION, Hamamatsu (JP)

(72) Inventor: Ryunosuke Daido, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/924,463

(22) Filed: Jul. 9, 2020

(65) Prior Publication Data

US 2020/0342848 A1 Oct. 29, 2020

Related U.S. Application Data

(63) Continuation of application No. PCT/JP2018/047757, filed on Dec. 26, 2018.

(30) Foreign Application Priority Data

Jan. 11, 2018 (JP) ..... JP2018-002451

(51) Int. Cl.
*G10L 13/00* (2006.01)
*G10L 13/06* (2013.01)
(Continued)

(52) U.S. Cl.
CPC ..... *G10L 13/047* (2013.01)

(58) Field of Classification Search
CPC ..... G10L 13/00; G10L 13/02; G10L 13/06
See application file for complete search history.

(56) References Cited

U.S. PATENT DOCUMENTS 6,324,505 B1 * 11/2001 Choy ..... G10L 19/0204 704/230
2003/0204543 A1 * 10/2003 Yoon ..... G06F 17/142 708/300

(Continued)

FOREIGN PATENT DOCUMENTS

JP 2010020137 A 1/2010
JP 2014002338 A 1/2014

OTHER PUBLICATIONS

International Search Report issued in Intl. Appln. No. PCT/JP2018/047757 dated Mar. 5, 2019. English translation provided.

(Continued)

*Primary Examiner* — Shreyans A Patel
(74) *Attorney, Agent, or Firm* — Rossi, Kimms & McDowell LLP

(57) ABSTRACT

A voice synthesis method designates a target feature of a voice to be synthesized; specifies harmonic frequencies for a plurality of respective harmonic components of the voice and an amplitude spectrum envelope of the voice; specifies a harmonic amplitude distribution of each of the plurality of respective harmonic components based on (i) the target feature, (ii) the amplitude spectrum envelope, and (iii) the harmonic frequency specified for the respective harmonic component, the harmonic amplitude distribution representing a distribution of amplitudes in a unit band with a peak amplitude corresponding to the respective harmonic component; and generates a frequency spectrum of the voice with the target feature based on harmonic amplitude distributions specified for each of the plurality of respective harmonic components and the amplitude spectrum envelope.

15 Claims, 9 Drawing Sheets

(51) Int. Cl.
*G10L 13/02* (2013.01)
*G10L 13/047* (2013.01)

(56) References Cited

U.S. PATENT DOCUMENTS

2003/0221542 A1* 12/2003 Kenmochi ..... G10H 7/002
84/616
2006/0069559 A1* 3/2006 Ariyoshi ..... G10L 13/033
704/246
2007/0288233 A1* 12/2007 Kim ..... G10L 25/93
704/208
2011/0112840 A1* 5/2011 Sakamoto ..... G10L 13/033
704/266
2014/0006018 A1* 1/2014 Bonada ..... G10L 21/013
704/208
2015/0302845 A1* 10/2015 Nakano ..... G10L 13/02
704/267

OTHER PUBLICATIONS

Written Opinion issued in Intl. Appln. No. PCT/JP2018/047757 dated Mar. 5, 2019.

* cited by examiner

VOICE SYNTHESIS METHOD, VOICE SYNTHESIS APPARATUS, AND RECORDING MEDIUM

CROSS REFERENCE TO RELATED APPLICATIONS

This application is a Continuation Application of PCT Application No. PCT/JP2018/047757, filed Dec. 26, 2018, and is based on and claims priority from Japanese Patent Application No. 2018-002451, filed Jan. 11, 2018, the entire contents of each of which are incorporated herein by reference.

BACKGROUND

Technical Field

The present disclosure relates to a technique for synthesizing a voice.

Description of Related Art

Various voice synthesis techniques for synthesizing a voice containing phonemes are known. For example, Japanese Patent Application Laid-Open Publication No. 2014-2338 (hereafter, "Patent Document 1") discloses generating a voice signal by use of, for example, sample concatenate-type voice synthesis, the voice signal representing a voice of desired phonemes having a neutral voice feature (an initial voice feature), and converting the generated voice signal to a voice signal representing a voice having a target feature, such as gravelliness or huskiness.

The technique disclosed in Patent Document 1 has a drawback in that processing is complicated since, after generation of a voice having the initial voice features, the voice is converted to have a target feature.

SUMMARY

It is thus an object of a preferred aspect of the present disclosure to provide a simplified process for generating a voice with a target feature.

In one aspect, a voice synthesis method designates a target feature of a voice to be synthesized; specifying harmonic frequencies for a plurality of respective harmonic components of the voice and an amplitude spectrum envelope of the voice; specifies a harmonic amplitude distribution of each of the plurality of respective harmonic components based on (i) the target feature, (ii) the amplitude spectrum envelope, and (iii) the harmonic frequency specified for the respective harmonic component, the harmonic amplitude distribution representing a distribution of amplitudes in a unit band with a peak amplitude corresponding to the respective harmonic component; and generates a frequency spectrum of the voice with the target feature based on harmonic amplitude distributions specified for each of the plurality of respective harmonic components and the amplitude spectrum envelope.

In another aspect, a voice synthesis apparatus includes a memory; and at least one processor, and the at least one processor, by execution of instructions stored in the memory, is configured to: designate a target feature of a voice to be synthesized; specify harmonic frequencies for a plurality of respective harmonic components of the voice and an amplitude spectrum envelope of the voice; specify a harmonic amplitude distribution for each of the plurality of respective harmonic components based on (i) the target feature, (ii) the amplitude spectrum envelope, and (iii) the harmonic frequency specified for the respective harmonic component, the harmonic amplitude distribution representing a distribution of amplitudes in a unit band with a peak amplitude corresponding to the respective harmonic component; and generate a frequency spectrum of the voice with the target feature based on harmonic amplitude distributions specified for each of the plurality of respective harmonic components and the amplitude spectrum envelope.

In still another aspect, a non-transitory computer-readable recording medium having stored therein a computer program for causing a computer to perform a voice synthesis method of: designating a target feature of a voice to be synthesized; specifying harmonic frequencies for a plurality of respective harmonic components of the voice and an amplitude spectrum envelope of the voice; specifying a harmonic amplitude distribution of each of the plurality of respective harmonic components based on (i) the target feature, (ii) the amplitude spectrum envelope, and (iii) the harmonic frequency specified for the respective harmonic component, the harmonic amplitude distribution representing a distribution of amplitudes in a unit band with a peak amplitude corresponding to the respective harmonic component; and generating a frequency spectrum of the voice with the target feature based on harmonic amplitude distributions specified for each of the plurality of respective harmonic components and the amplitude spectrum envelope.

DESCRIPTION OF THE EMBODIMENTS

First Embodiment

Figure 1:
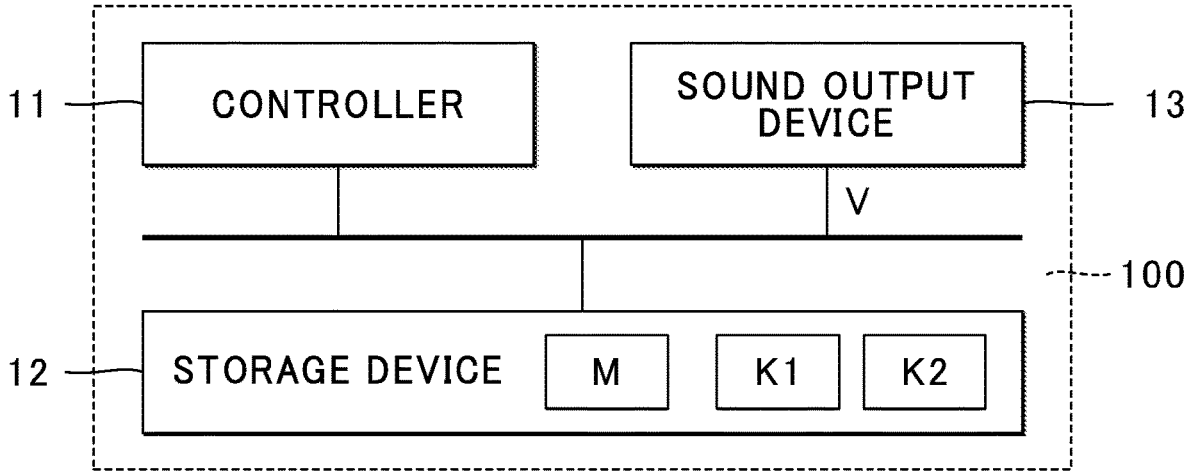
FIG. 1 is a block diagram illustrating a configuration of a voice synthesis apparatus according to a first embodiment of the present disclosure.

FIG. 1 is a block diagram illustrating an example of a configuration of a voice synthesis apparatus 100 according to a first embodiment of the present disclosure. The voice synthesis apparatus 100 in the first embodiment is a singing voice synthesis apparatus that synthesizes a virtual singing voice of a singer (hereafter, "voice to be synthesized"). As illustrated in FIG. 1, the voice synthesis apparatus 100 is realized by a computer system that includes a controller 11, a storage device 12, and a sound output device 13. By way of example, preferable as the voice synthesis apparatus 100 is a portable information terminal, such as a mobile phone or a smartphone, or a portable or stationary information terminal, such as a personal computer.

The controller 11 has, for example, one or more processors such as a CPU (Central Processing Unit) and controls overall components that constitute the voice synthesis apparatus 100. The controller 11 in the first embodiment generates a time-domain voice signal V that represents the waveform of the voice to be synthesized. The sound output device 13 (for example, a loudspeaker or a headphone) reproduces a voice that is represented by the voice signal V generated by the controller 11. For convenience, illustrations are omitted of a digital-to-analog converter that converts the voice signal V generated by the controller 11 from a digital signal to an analog signal, and an amplifier that amplifies the voice signal V. Although in FIG. 1 there is illustrated a configuration in which the sound output device 13 is mounted on the voice synthesis apparatus 100, the sound output device 13 may be provided separate from the voice synthesis apparatus 100 and connected either by wire or wirelessly to the voice synthesis apparatus 100.

The storage device 12 is constituted of, for example, a known recording medium such as a magnetic recording medium or a semiconductor recording medium, or a combination of types of recording media, and has stored therein a computer program (instructions for causing the controller to perform a voice synthesis method) executed by the controller 11 and various types of data used by the controller 11. The storage device 12 (for example, cloud storage) may be provided separate from the voice synthesis apparatus 100 to enable the controller 11 to write to and read from the storage device 12 via a communication network, such as a mobile communication network or the Internet. That is, the storage device 12 may be omitted from the voice synthesis apparatus 100.

The storage device 12 has stored therein song data M representative of content of a song. The song data M in the first embodiment are indicative of a pitch, a phoneme, and a sound period with respect to each of notes constituting the song. The pitches are, for example, MIDI (Musical Instrument Digital Interface) note numbers. Each of the phonemes is content vocalized by the voice to be synthesized (that is, lyrics of the song). The sound period is a period during which each note of the song is vocalized and can be defined by, for example, a start point of a note and an end point of the note, or as the start point of the note and subsequent duration of the note. The song data M in the first embodiment specifies a voice feature of the voice to be synthesized (hereafter, "target feature"). For example, a voice feature, such as a voice with gravelliness or a voice with huskiness, is designated by the song data M as the target feature. The target feature also includes a neutral voice feature other than distinctive features, such as gravelliness or huskiness.

Figure 2:
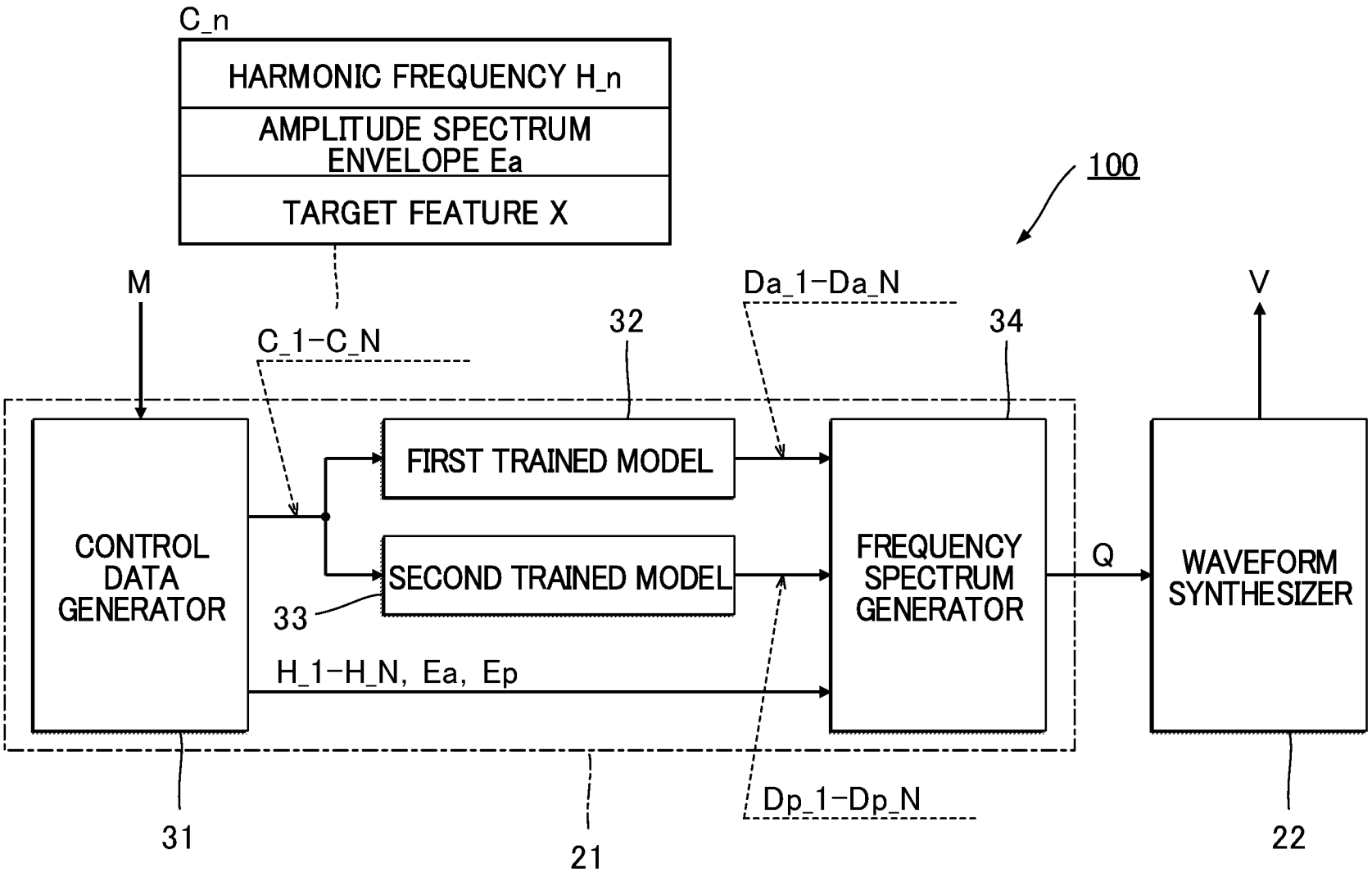
FIG. 2 is a block diagram illustrating a functional configuration of the voice synthesis apparatus.

FIG. 2 is a block diagram illustrating an example of a functional configuration of the controller 11. As illustrated in FIG. 2, the controller 11 realizes functions (a harmonic processor 21 and a waveform synthesizer 22) for generating a voice signal V according to the song data M upon execution of a computer program stored in the storage device 12. The functions of the controller 11 may be realized by a set of apparatuses (that is, a system). Alternatively, some or all of the functions of the controller 11 may be realized by dedicated electronic circuitry (for example, signal processing circuitry).

The harmonic processor 21 sequentially generates frequency spectra Q based on the song data M for unit periods (frames) on a time axis. A frequency spectrum Q is a complex spectrum consisting of an amplitude spectrum Qa and a phase spectrum Qp. The waveform synthesizer 22 generates a time-domain voice signal V based on a series of frequency spectra Q sequentially generated by the harmonic processor 21. A discrete inverse Fourier transform can be used for generation of the voice signal V. The voice signal V generated by the waveform synthesizer 22 is supplied to the sound output device 13 for reproduction as sound waves.

Figure 3:
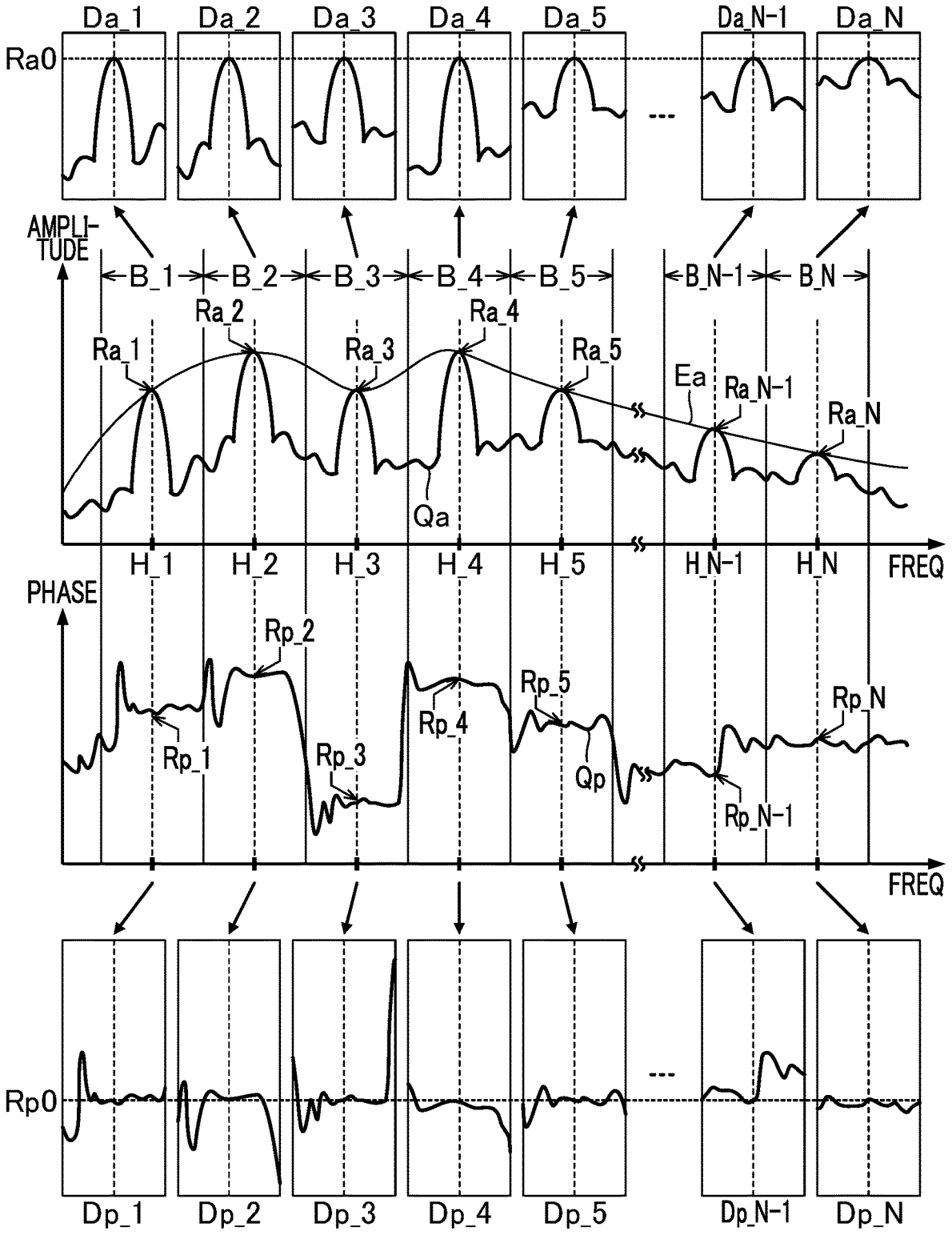
FIG. 3 is an explanatory diagram of amplitude spectra and phase spectra.

FIG. 3 is a schematic diagram illustrating an amplitude spectrum Qa and a phase spectrum Qp constituting a frequency spectrum Q generated by the harmonic processor 21. As shown in FIG. 3, a harmonic structure exists in the amplitude spectrum Qa of the voice to be synthesized (particularly, a voiced sound). The harmonic structure consists of N harmonic components arranged at intervals. The peak of an n-th (n=1 to N) harmonic component resides at a frequency that is approximately n times that of the fundamental frequency F0. The first harmonic component is a fundamental tone component a peak amplitude of which is the fundamental frequency F0, and the second or any subsequent harmonic component is an n-order overtone component a peak amplitude of which is an overtone frequency nF0 that is n times that of the fundamental frequency F0. In the following explanations, a harmonic frequency H_n expresses a frequency that is n times that of the fundamental frequency F0 (the fundamental frequency F0 and each overtone frequency nF0). A harmonic frequency H_1 corresponds to the fundamental frequency F0.

FIG. 3 shows an amplitude spectrum envelope Ea indicative of a contour of the amplitude spectrum Qa. A top of a peak of each harmonic component is on the amplitude spectrum envelope Ea. That is, an amplitude at a harmonic frequency H_n of each harmonic component of the amplitude spectrum envelope Ea corresponds to the peak amplitude of the harmonic component.

As shown in FIG. 3, the amplitude spectrum Qa is divided on a frequency axis into N unit bands B_1 to B_N corresponding to different harmonic components. An amplitude peak for the n-th harmonic component occurs within a unit band B_n. For example, a midpoint between two adjacent harmonic frequencies H_n and H_n+1 on a frequency axis is defined as a boundary of two adjacent unit bands B_n and B_n+1. Hereafter, of the amplitude spectrum Qa, an amplitude distribution in the unit band B_n will be referred to as a "harmonic amplitude distribution Da_n." As will be apparent from FIG. 3, the amplitude spectrum Qa consists of N harmonic amplitude distributions Da_1 to Da_N arranged on a frequency axis along the amplitude spectrum envelope Ea.

As shown in FIG. 3, the phase spectrum Qp is divided on a frequency axis into N unit bands B_1 to B_N similarly to the amplitude spectrum Qa. Hereafter, of the phase spectrum Qp, a phase distribution in the unit band B_n will be referred to as a "harmonic phase distribution Dp_n." As will be apparent from FIG. 3, the phase spectrum Qp consists of N harmonic phase distributions Dp_1 to Dp_N arranged on the frequency axis. The bandwidth of the unit band B_n may vary depending on the fundamental frequency F0, for example.

As shown in FIG. 2, the harmonic processor 21 includes a control data generator 31, a first trained model 32, a second trained model 33, and a frequency spectrum generator 34.

The control data generator 31 sequentially generates, for each unit period (frame) on a time axis, an amplitude spectrum envelope Ea, a phase spectrum envelope Ep, and N portions of control data C_1 to C_N. The first trained model 32 is a predictive statistical model for specifying a harmonic amplitude distribution Da_n corresponding to control data C_n. The first trained model 32 outputs, for each unit period, N harmonic amplitude distributions Da_1 to Da_N that correspond respectively to N portions of control data C_1 to C_N generated by the control data generator 31. The second trained model 33 is a predictive statistical model for specifying a harmonic phase distribution Dp_n corresponding to the control data C_n. The second trained model 33 outputs, for each unit period, N harmonic phase distributions Dp_1 to Dp_N that correspond respectively to N portions of control data C_1 to C_N generated by the control data generator 31. As will be understood from the above explanations, the control data C_n define conditions for the harmonic amplitude distribution Da_n and the harmonic phase distribution Dp_n.

As shown in FIG. 2, the control data C_n corresponding to the n-th harmonic component specify the harmonic frequency H_n, the amplitude spectrum envelope Ea, and a target feature X indicative of desired voice features. The amplitude spectrum envelope Ea and the target feature X are the same for the N harmonic components.

The harmonic frequency H_n is, as described above, a frequency (nF0) at which the amplitude of the n-th harmonic component peaks. The harmonic frequency H_n can be specified by an individual numerical value for each harmonic component, or can be specified by a combination of the fundamental frequency F0 and a harmonic order n. The control data generator 31 may set a harmonic frequency H_n that varies depending on a pitch of a note specified by the song data M. For example, the harmonic frequency H_n is calculated as n times of a fundamental frequency F0 corresponding to the pitch specified by the song data M. The control data generator 31 may use any method to set the harmonic frequency H_n. For example, the control data generator 31 may set the harmonic frequency H_n, using a predictive statistical model that has learned some relations between the song data M and the harmonic frequency H_n (or the fundamental frequency F0) through machine learning. Preferably, the predictive statistical model is a nueral network (hereafter, "NN").

As described above, the amplitude spectrum envelope Ea is a contour of amplitude spectrum Qa of the voice to be synthesized. The amplitude spectrum envelope Ea does not include a fine structure near a harmonic component in the harmonic amplitude distribution Da_n. The amplitude spectrum envelope Ea may be expressed by using a predetermined number of lower order Mel-Cepstrum coefficients, for example. The control data generator 31 specifies the amplitude spectrum envelope Ea based on information on phonemes specified by the song data M. The amplitude spectrum envelope Ea may be prepared in advance and stored in the storage device 12 for each phoneme. In this case, the control data generator 31 selects from among amplitude spectrum envelopes Ea stored in the storage device 12 an amplitude spectrum envelope Ea that corresponds to a phoneme specified by the song data M. The control data C_n include thus-selected amplitude spectrum envelope Ea. Any known method may be employed for specifying the amplitude spectrum envelope Ea. The amplitude spectrum envelope Ea may be specified using a predictive statistical model (e.g., NN) with learned relations between the song data M and the amplitude spectrum envelope Ea.

The phase spectrum envelope Ep is a contour of the phase spectrum Qp of the voice to be synthesized. The phase spectrum envelope Ep does not include a fine structure near a harmonic component in the harmonic phase distribution Dp_n. The control data generator 31 specifies the phase spectrum envelope Ep based on information on phonemes specified by the song data M. The phase spectrum envelope Ep may be prepared in advance and be stored for each phoneme in the storage device 12. The control data generator 31 selects, from among phase spectrum envelopes Ep stored in the storage device 12, a phase spectrum envelope Ep that corresponds to a phoneme specified by the song data M. The phase spectrum envelope Ep can be expressed in any data format. Any known method may be employed for specifying the phase spectrum envelope Ep. The phase spectrum envelope Ep may be specified using a predictive statistical model (e.g., NN) by which some relations between the song data M and the phase spectrum envelope Ep have been learned.

The first trained model 32 is a predictive statistical model by which some relations between the control data C_n and the harmonic amplitude distribution Da_n for a singing voice of a specific singer (hereafter, "target singer") have been learned. Preferably, the first trained model 32 is an NN that estimates and outputs the harmonic amplitude distribution Da_n in accordance with an input that includes the control data C_n. Specifically, the first trained model 32 is preferably a simple feed-forward type NN, a recurrent NN (RNN) using Long Short Term Memory, or a developmental NN of such a type. The first trained model 32 may comprise plural types of NNs.

The first trained model 32 is a trained model that has been trained through machine learning (particularly, deep learning) by use of teacher data in which the control data C_n and the harmonic amplitude distribution Da_n are associated with each other. Thus, by the first trained model 32, some relations between the control data C_n and the harmonic amplitude distribution Da_n are learned. Coefficients K1 that define the first trained model 32 are established through machine learning by use of teacher data that correspond to different target features X, and are stored in the storage device 12. Thus, a harmonic amplitude distribution Da_n that is statistically adequate for unknown control data C_n under a tendency extracted from the teacher data (the relations between control data C_n and harmonic amplitude distribution Da_n) is output from the first trained model 32 of the specific singer. Thus, the harmonic amplitude distribution Da_n corresponds to an amplitude distribution of the n-th harmonic component of the amplitude spectrum Qa of a voice of the target singer vocalizing, with the target feature X, a pitch and a phoneme specified by the song data M. In the first trained model 32 only a part of lower order coefficients may be used out of all the coefficients of the amplitude spectrum envelope Ea contained in the control data C_n to estimate the harmonic amplitude distribution Da_n.

The second trained model 33 is a predictive statistical model by which some relations between the control data C_n and the harmonic phase distribution Dp_n of a singing voice of the target singer have been learned. Preferably, the second trained model 33 is an NN that estimates and outputs the harmonic phase distribution Dp_n in accordance with an input that includes the control data C_n. For the second trained model 33 there may be adopted a known NN of various types similarly to the first trained model 32.

The second trained model 33 is a trained model that has been trained through machine learning (particularly, deep learning) by use of teacher data in which the control data C_n and the harmonic phase distribution Dp_n are associated with each other. Thus, the second trained model 33 is a model by which relations between the control data C_n and the harmonic phase distribution Dp_n have been learned. Coefficients K2 that define the second trained model 33 are established through machine learning by use of teacher data that correspond to different target features X, and are stored in the storage device 12. Thus, a harmonic phase distribution Dp_n that is statistically adequate for unknown control data C_n under a tendency extracted from the teacher data (the relations between control data C_n and harmonic phase distributions Dp_n) is output from the second trained model 33. Thus, the harmonic phase distribution Dp_n corresponds to a phase distribution of the n-th harmonic component among the phase spectrum Qp of a voice of the target singer vocalizing with the target feature X the pitch and the phoneme specified by the song data M. The second trained model 33 may use only a part of lower order coefficients from among all the coefficients of the amplitude spectrum envelope Ea contained in the control data C_n to estimate the harmonic phase distribution Dp_n.

As will be apparent from FIG. 3, the harmonic amplitude distribution Da_n output from the first trained model 32 for each harmonic component represents an amplitude distribution relative to an amplitude at the harmonic frequency H_n (hereafter, "typical amplitude") Ra_n. That is, each of amplitudes that constitute the harmonic amplitude distribution Da_n is a numeric value relative to a typical amplitude Ra_n that serves as a predetermined reference value Ra0 (e.g., Ra0=0). The relative value may be either a difference in linear amplitude or a difference in logarithmic amplitude (i.e., a linear amplitude ratio). The typical amplitude Ra_n of the harmonic amplitude distribution Da_n is a top amplitude at the peak of amplitudes that corresponds to a harmonic component. Similarly, the harmonic phase distribution Dp_n output by the second trained model 33 for each harmonic component is a distribution of a phase relative to a phase (hereafter, "typical phase") Rp_n at the harmonic frequency H_n. Thus, each of the phases that constitute the harmonic phase distribution Dp_n is a numeric value relative to a typical phase Rp_n that serves as a predetermined reference value Rp0 (e.g., Rp0=0). The reference value Ra0 and the reference value Rp0 may take a value other than 0.

As described in the foregoing, a sequence of N harmonic amplitude distributions Da_1 to Da_N is output from the first trained model 32 for each unit period; and a sequence of N harmonic phase distributions Dp_1 to Dp_N is output from the second trained model 33 for each unit period. The frequency spectrum generator 34 in FIG. 2 generates a frequency spectrum Q of the voice to be synthesized based on the amplitude spectrum envelope Ea, the phase spectrum envelope Ep, the N harmonic amplitude distributions Da_1 to Da_N output by the first trained model 32, and the N harmonic phase distributions Dp_1 to Dp_N output by the second trained model 33. The frequency spectrum Q is generated for each unit period, i.e., each time the N harmonic amplitude distributions Da_1 to Da_N and the N harmonic phase distributions Dp_1 to Dp_N are generated. As shown in FIG. 3, the frequency spectrum Q is a complex spectrum consisting of the amplitude spectrum Qa and the phase spectrum Qp.

Specifically, the frequency spectrum generator 34 performs the following processing. Firstly, the frequency spectrum generator 34 allocates each of the N harmonic amplitude distributions Da_1 to Da_N and each of the N harmonic phase distributions Dp_1 to Dp_N to each harmonic frequency H_n on a frequency axis. Secondly, the frequency spectrum generator 34 adjusts each harmonic amplitude distribution Da_n such that the typical amplitude Ra_n of the harmonic amplitude distribution Da_n is positioned on the amplitude spectrum envelope Ea. The harmonic amplitude distribution Da_n may be adjusted by adding a constant thereto in a case that the harmonic amplitude distribution Da_n is a logarithmic amplitude, or by multiplication of the harmonic amplitude distribution Da_n by a constant in a case that the harmonic amplitude distribution Da_n is a linear amplitude. Thirdly, the frequency spectrum generator 34 adjusts each harmonic phase distribution Dp_n such that the typical phase Rp_n of the harmonic phase distribution Dp_n is positioned on the phase spectrum envelope Ep. The harmonic phase distribution Dp_n is adjusted by adding a constant to the harmonic phase distribution Dp_n. The frequency spectrum generator 34 synthesizes the N harmonic amplitude distributions Da_1 to Da_N and the N harmonic phase distributions Dp_1 to Dp_N after the adjustments, to generate the frequency spectrum Q. In a case in which two harmonic components adjacent on a frequency axis, namely a harmonic amplitude distribution Da_n and a harmonic amplitude distribution Da_n+1, overlap each other, the overlapping portions are added on a complex plane. In a case in which the harmonic amplitude distribution Da_n and the harmonic amplitude distribution Da_n+1 are apart from each other, a gap therebetween is kept unchanged. The frequency spectrum Q generated by the above processing corresponds to frequency characteristics of a voice of the target singer vocalizing the pitch and the phoneme specified by the song data M with the target feature X. In the above explanation, the adjustment of the harmonic amplitude distribution Da_n (adjustment amount a) and the adjustment of the harmonic phase distribution Dp_n (adjustment amount p) are independently performed. However, the harmonic amplitude distribution Da_n and the harmonic phase distribution Dp_n may be synthesized to obtain a complex expression value, and then the obtained value may be multiplied by a complex number $\{a \times \exp(jp)\}$. In this way, the adjustment of the harmonic amplitude distribution Da_n and the adjustment of the harmonic phase distribution Dp_n can be performed concurrently (j is an imaginary unit).

The frequency spectrum Q generated by the frequency spectrum generator 34 is output for each unit period from the harmonic processor 21 to the waveform synthesizer 22. As described above, the waveform synthesizer 22 generates a time-domain voice signal V based on a series of frequency spectra Q, each of which is generated by the harmonic processor 21 for a corresponding unit period.

Figure 4:
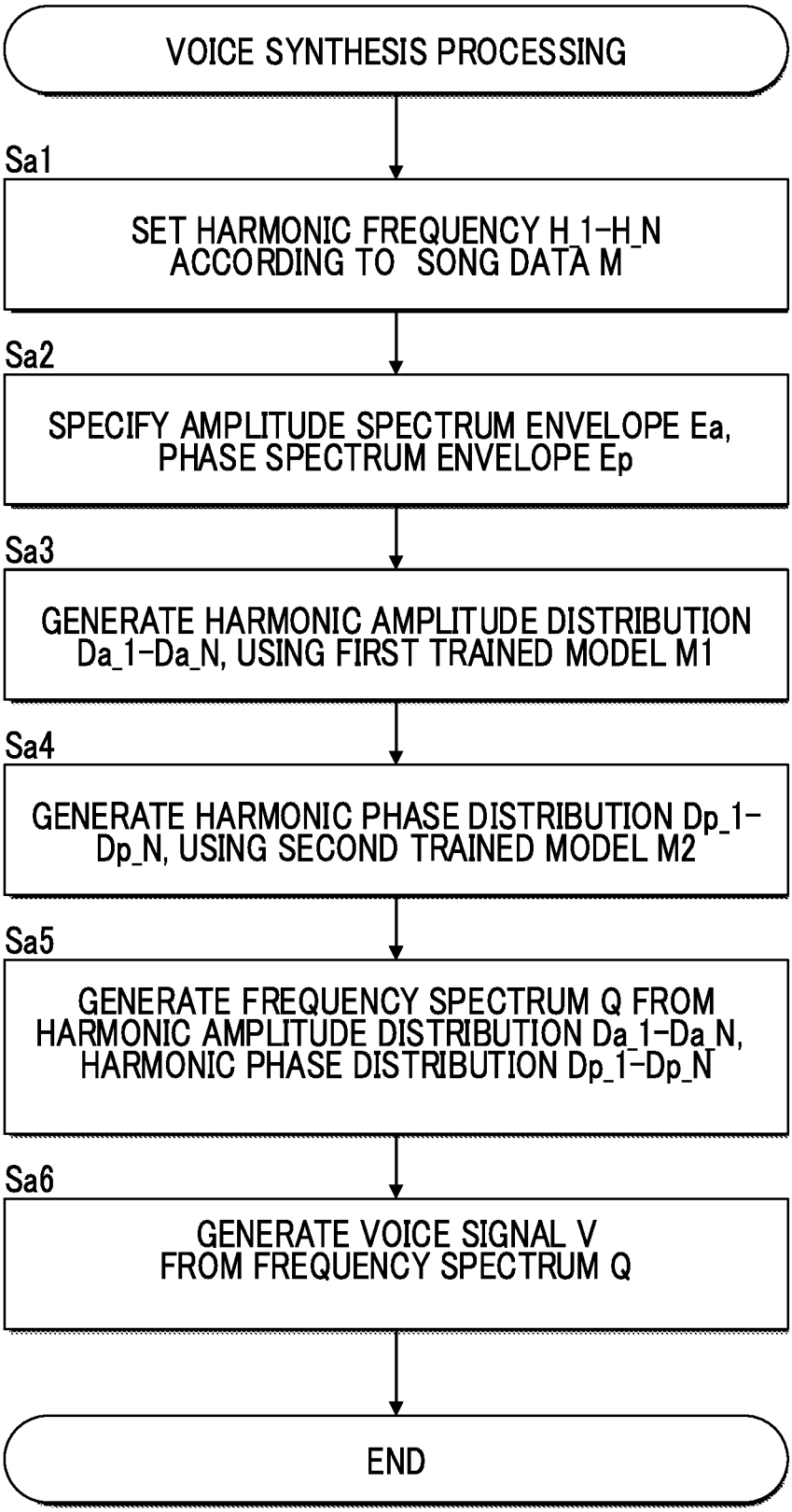
FIG. 4 is a flowchart of voice synthesis processing.

FIG. 4 is a flowchart showing a flow of voice synthesis processing performed by the controller 11. The voice synthesis processing synthesizes a voice signal V representative of a synthesized voice vocalized by the target singer with the target feature X. The voice synthesis processing is initiated by an instruction from a user of the voice synthesis apparatus 100 acting as a trigger, and is repeated for each unit period.

When the voice synthesis processing starts for a unit period, the control data generator 31 generates N portions of control data C_1 to C_N (Sa1, Sa2). Specifically, the control data generator 31 sets N harmonic frequencies H_1 to H_N based on the song data M (Sa1). The control data generator 31 may set respective N harmonic frequencies H_1 to H_N individually. The control data generator 31 may set the N harmonic frequencies H_1 to H_N each to be an n-time multiple of a fundamental frequency F0. The control data generator 31 specifies an amplitude spectrum envelope Ea and a phase spectrum envelope Ep based on the song data M (Sa2). The harmonic frequency H_n, the amplitude spectrum envelope Ea and the phase spectrum envelope Ep may be features corresponding to the target singer or those corresponding to a singer than the target singer. The harmonic frequency H_n, the amplitude spectrum envelope Ea and the phase spectrum envelope Ep may be features that correspond to the target feature X, or may be features that do not correspond to the target feature X. The step of setting the harmonic frequency H_n (Sa1) and the step of specifying the amplitude spectrum envelope Ea and phase spectrum envelope Ep (Sa2) may be performed in reverse order. As a result of the above processing, control data C_n including the harmonic frequency H_n, the amplitude spectrum envelope Ea, and the target feature X are generated.

The controller 11 supplies the first trained model 32 with the N portions of control data C_1 to C_N to generate corresponding N harmonic amplitude distributions Da_1 to Da_N (Sa3). The controller 11 supplies the second trained model 33 with the N portions of control data C_1 to C_N to generate corresponding N harmonic phase distributions Dp_1 to Dp_N (Sa4). The step of generating the N harmonic amplitude distributions Da_1 to Da_N (Sa3) and the step of generating the N harmonic phase distributions Dp_1 to Dp_N (Sa4) may be performed in reverse order.

The frequency spectrum generator 34 generates a frequency spectrum Q with the target feature X based on the amplitude spectrum envelope Ea, the phase spectrum envelope Ep, the N harmonic amplitude distributions Da_1 to Da_N, and the N harmonic phase distributions Dp_1 to Dp_N (Sa5). More specifically, the frequency spectrum generator 34 synthesizes the N harmonic amplitude distributions Da_1 to Da_N adjusted according to the amplitude spectrum envelope Ea, and the N harmonic phase distributions Dp_1 to Dp_N adjusted according to the phase spectrum envelope Ep to generate the frequency spectrum Q. The waveform synthesizer 22 generates a time-domain voice signal V based on the frequency spectrum Q (Sa6). Voice signals V generated for respective unit periods by repeating the above processing are partially superposed and added on a time axis. As the result, a voice signal V is generated that is representative of a voice in accordance with the pitch and phoneme specified by the song data M vocalized with the target feature X.

As described, in the first embodiment, the harmonic amplitude distribution Da_n is specified for each harmonic component based on the target feature X, the harmonic frequency H_n, and the amplitude spectrum envelope Ea. The frequency spectrum Q (amplitude spectrum) of a voice with the target feature X is generated based on the amplitude spectrum envelope Ea and the N harmonic amplitude distributions Da_1 to Da_N. Accordingly, an advantage is in that a voice with the target feature X is synthesized by a simplified process as compared with the technique in Patent Document 1 of synthesizing a voice with neutral voice features and converting the synthesized voice into a voice with target feature.

In the first embodiment, the first trained model 32 having learned the relation between the control data C_n and the harmonic amplitude distribution Da_n is used to specify the harmonic amplitude distribution Dan of each harmonic component. Accordingly, it is possible to appropriately specify a harmonic amplitude distribution Da_n that corresponds to unknown control data C_n. Further, another advantage is in that, since the shapes of different harmonic amplitude distributions Da_n are close to each other, a relatively small-scale predictive statistical model (e.g., NN) can be employed as the first trained model 32. Also, since the shapes of different harmonic amplitude distributions Da_n close to each other, a critical issue in terms of voice quality is unlikely to arise such as a breakdown in the waveform of the voice signal V, even if the harmonic amplitude distribution Da_n estimation turns out to be erroneous.

The harmonic phase distribution Dp_n for each harmonic component is specified based on the target feature X, the harmonic frequency H_n, and the amplitude spectrum envelope Ea. The frequency spectrum Q (phase spectrum) of a voice having the target feature X is generated based on the phase spectrum envelope Ep and the N harmonic phase distributions Dp_1 to Dp_N. Accordingly, it is possible to synthesize a voice having the target feature X with an appropriate phase spectrum. In the first embodiment, in particular, the second trained model 33 by which relations between the control data C_n and the harmonic phase distribution Dp_n have been learned is used to specify the harmonic phase distribution Dp_n for each harmonic component. Thus, it is possible to appropriately specify a harmonic phase distribution Dp_n that corresponds to unknown control data C_n.

In the first embodiment, since a distribution of amplitude values relative to the typical amplitude Ra_n is used as a harmonic amplitude distribution Da_n, it is possible to generate an appropriate frequency spectrum Q regardless of whether the typical amplitude Ra_n is high or low. Similarly, since a distribution of phase values relative to the typical phase Rp_n is used as a harmonic phase distribution Dp_n, it is possible to generate an appropriate frequency spectrum Q regardless of whether the typical phase Rp_n is high or low.

Second Embodiment

The second embodiment of the present disclosure will now be described. It is of note that in each mode described below, like reference signs are used for elements having functions or effects identical to those of elements described in the first embodiment, and detailed explanations of such elements are omitted as appropriate.

Figure 5:
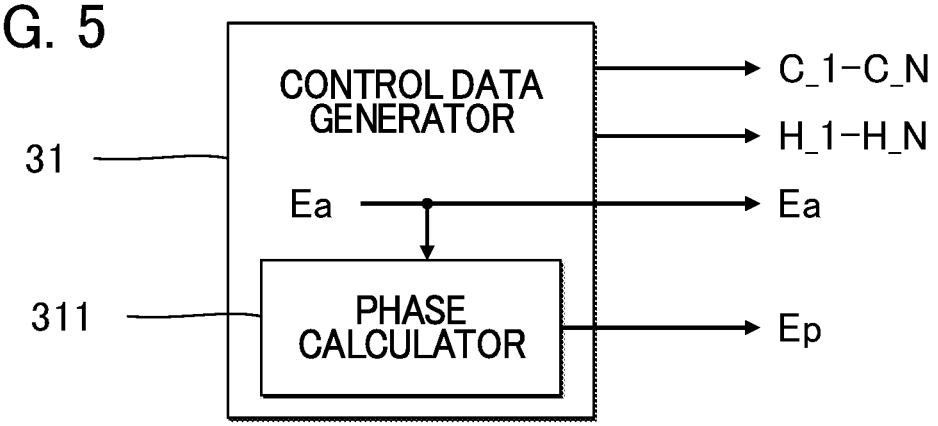
FIG. 5 is a block diagram illustrating a functional configuration of a voice synthesis apparatus according to a second embodiment.

FIG. 5 is a block diagram showing a partial functional configuration of the controller 11 in the second embodiment. As shown in FIG. 5, the control data generator 31 in the second embodiment includes a phase calculator 311. The phase calculator 311 generates, as an alternative form of the phase spectrum envelope Ep, a sequence of numerical values on a frequency axis calculated based on the amplitude spectrum envelope Ea.

The phase calculator 311 in the second embodiment calculates a minimum phase corresponding to the amplitude spectrum envelope Ea, and employs the calculated minimum phase as the phase spectrum envelope Ep0. Specifically, the phase calculator 311 employs a minimum phase as the phase spectrum envelope Ep0, where the minimum phase is calculated by performing a Hilbert transform on logarithmic values of the amplitude spectrum envelope Ea. For example, the phase calculator 311 first performs an inverse discrete Fourier transform on the logarithmic values of the amplitude spectrum envelope Ea, to generate a time-domain sample sequence. Secondly, the phase calculator 311 performs a discrete Fourier transform after changing, from among the time-domain sample sequence, samples corresponding to time points having negative values on a time axis to each have a value of zero, and doubling the values of samples that correspond to respective time points except for the origin (the time zero) and time points F/2 (F being the number of samples in the discrete Fourier transform) on the time axis.

Thirdly, the phase calculator 311 extracts the imaginary part (i.e., a minimum phase) from the outcome of the discrete Fourier transform, to be in the form of the phase spectrum envelope Ep0.

The phase calculator 311 sets phase reference positions (pitch marks) in respective unit periods that correspond to a series of fundamental frequencies F0. Specifically, the phase calculator 311 integrates the amount of changes in phase depending on each fundamental frequency F0 to obtain a series of instantaneous phases, and determines a position on a time axis at which the instantaneous phase takes a value of ($\theta$+2 M$\pi$) at around the midpoint of each unit period to be a phase reference position for that unit period. The sign $\theta$ is a real number, and the sign m is an integer. The phase calculator 311 linearly shifts (i.e., moves on a time axis) the phase of the phase spectrum envelope Ep0 by a time difference between the midpoint of each unit period and the phase reference position, to generate the phase spectrum envelope Ep. The frequency spectrum generator 34 generates a frequency spectrum Q based on the thus-calculated phase spectrum envelope Ep in the same manner as in the first embodiment.

The same technical effects as in the first embodiment are attainable in the second embodiment also. In the second embodiment, an advantage is in the simple process of setting the phase spectrum envelope Ep since the phase spectrum envelope Ep is calculated from the amplitude spectrum envelope Ea.

Third Embodiment

Figure 6:
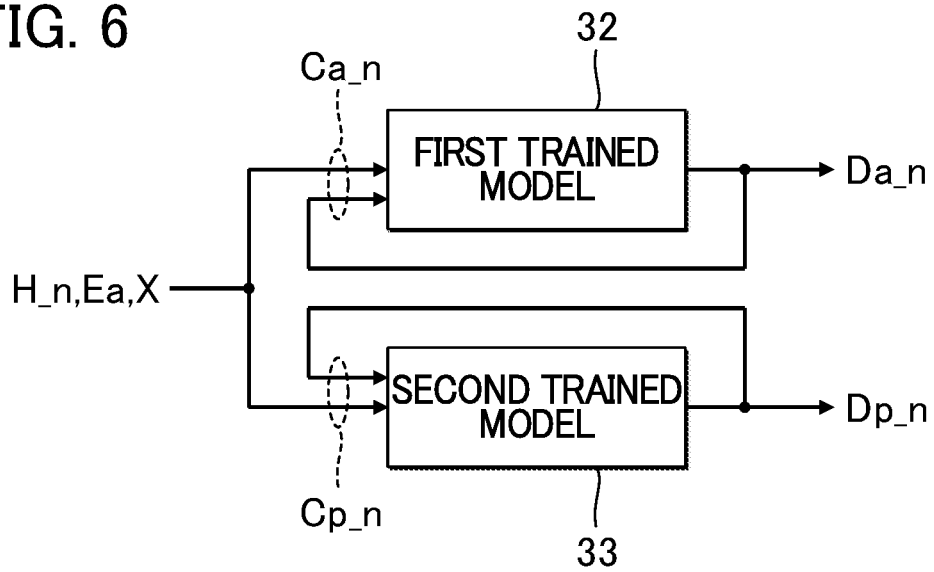
FIG. 6 is a block diagram illustrating a functional configuration of a voice synthesis apparatus according to a third embodiment.

FIG. 6 is a block diagram showing a partial functional configuration of the controller 11 in the third embodiment. As shown in FIG. 6, control data Ca_n are supplied to a first trained model 32 of the third embodiment. The control data Ca_n for each harmonic component in a t-th unit period (an example of a first unit period) contain a harmonic amplitude distribution Da_n specified by the first trained model 32 for an immediately previous (t−1)-th unit period (an example of a second unit period) in addition to the same elements as those in the control data C_n in the first embodiment (a harmonic frequency H_n, an amplitude spectrum envelope Ea, and a target feature X). That is, a harmonic amplitude distribution Da_n specified for each unit period is fed back as an input for calculating a harmonic amplitude distribution Da_n in an immediately following unit period. The first trained model 32 of the third embodiment is a predictive statistical model by which some relations between control data Ca_n and harmonic amplitude distributions Da_n have been learned, wherein the control data Ca_n includes a harmonic frequency H_n, an amplitude spectrum envelope Ea, a target feature X, and an immediately preceding harmonic amplitude distribution Da_n.

As shown in FIG. 6, control data Cp_n are supplied to a second trained model 33 of the third embodiment. The control data Cp_n for each harmonic component in the t-th unit period contain a harmonic phase distribution Dp_n specified by the second trained model 33 for an immediately preceding (t−1)-th unit period, in addition to the same elements as those in the control data C_n in the first embodiment (the harmonic frequency H_n, the amplitude spectrum envelope Ea and the target feature X). The second trained model 33 of the third embodiment is a predictive statistical model by which relations between the control data Cp_n and harmonic phase distributions Dp_n have been learned, wherein the control data Cp_n includes the harmonic frequency H_n, the amplitude spectrum envelope Ea, the target feature X, and an immediately preceding harmonic phase distribution Dp_n.

The same technical effects as those in the first embodiment are attainable in the third embodiment. Further, in the third embodiment, control data Ca_n in each unit period include a harmonic amplitude distribution Da_n specified in an immediately preceding unit period. Accordingly, it is possible to specify a series of appropriate harmonic amplitude distributions Da_n that reflects a tendency in temporal changes in the harmonic amplitude distribution Da_n across the teacher data. Similarly, control data Cp_n in each unit period include a harmonic phase distribution Dp_n specified in an immediately preceding period. Accordingly, it is possible to specify a series of appropriate harmonic phase distributions Dp_n that reflects a tendency in temporal changes in the harmonic phase distribution Dp_n across the teacher data. A configuration of calculating the phase spectrum envelope Ep from the amplitude spectrum envelope Ea in the second embodiment may be adopted in the third embodiment.

Fourth Embodiment

Figure 7:
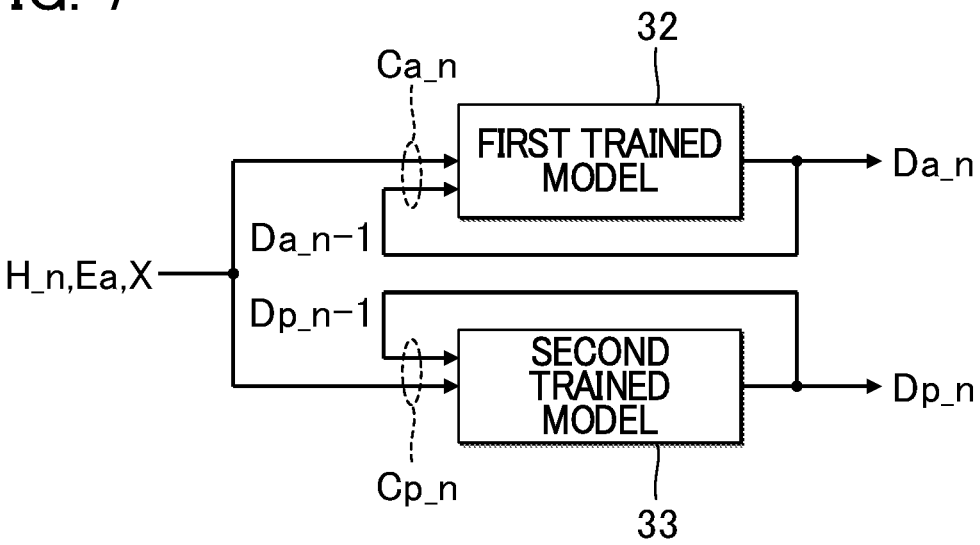
FIG. 7 is a block diagram illustrating a functional configuration of a voice synthesis apparatus according to a fourth embodiment.

FIG. 7 is a block diagram showing a partial functional configuration of the controller 11 in the fourth embodiment. As shown in FIG. 7, control data Ca_n are supplied to a first trained model 32 of the fourth embodiment. The control data Ca_n for an n-th harmonic component (an example of a first harmonic component) contain a harmonic amplitude distribution Da_n−1 specified by the first trained model 32 for an (n−1)-th harmonic component adjacent the n-th harmonic component on a frequency axis (an example of a second harmonic component), in addition to the same elements as those in the control data C_n in the first embodiment (a harmonic frequency H_n, an amplitude spectrum envelope Ea, and a target feature X). The first trained model 32 of the fourth embodiment is a predictive statistical model by which some relations between control data Ca_n and harmonic amplitude distributions Da_n have been learned, wherein the control data Ca_n includes a harmonic frequency H_n, an amplitude spectrum envelope Ea, a target feature X, and the harmonic amplitude distribution Da_n−1 of another harmonic component.

As shown in FIG. 7, control data Cp_n are supplied to the second trained model 33 of the fourth embodiment. The control data Cp_n for the n-th harmonic component contain a harmonic phase distribution Dp_n−1 specified by the first trained model 32 for an (n−1)-th harmonic component adjacent the n-th harmonic component on a frequency axis in addition to the same elements as those in the control data C_n in the first embodiment (the harmonic frequency H_n, the amplitude spectrum envelope Ea, and the target feature X). The second trained model 33 of the fourth embodiment is a predictive statistical model which has learned the relation between the control data Cp_n and the harmonic phase distribution Dp_n, wherein the control data Cp_n includes a harmonic frequency H_n, an amplitude spectrum envelope Ea, a target feature X, and the harmonic phase distribution Dp_n−1 of another harmonic component.

The same technical effects as those in the first embodiment can be attained in the fourth embodiment. In the fourth embodiment, the control data Ca_n for specifying the harmonic amplitude distribution Da_n of each harmonic component include a harmonic amplitude distribution Da_n−1 specified for another harmonic component adjacent the subject harmonic component on a frequency axis. Accordingly, it is possible to specify an appropriate harmonic amplitude distribution Da_n that reflects a correlative tendency between harmonic amplitude distributions Da_n in the teacher data. Similarly, the control data Cp_n for specifying a harmonic phase distribution Dp_n of each harmonic component include a harmonic phase distribution Dp_n−1 determined for another harmonic component adjacent the subject harmonic component on the frequency axis. Accordingly, it is possible to specify an appropriate harmonic phase distribution Dp_n that reflects a correlative tendency between harmonic phase distributions Dp_n in the teacher data. A configuration of calculating the phase spectrum envelope Ep from the amplitude spectrum envelope Ea in the second embodiment may be adopted in the fourth embodiment.

Fifth Embodiment

Figure 8:
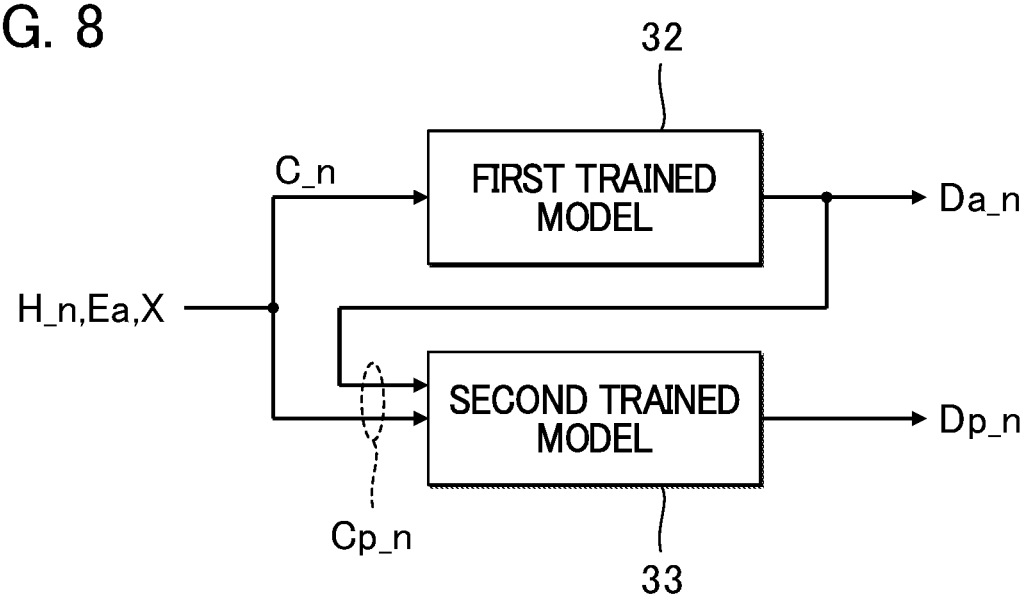
FIG. 8 is a block diagram illustrating a functional configuration of a voice synthesis apparatus according to a fifth embodiment.

FIG. 8 is a block diagram showing a partial functional configuration of the controller 11 in the fifth embodiment. An input to and an output from a first trained model 32 are the same as those of the first embodiment. That is, the first trained model 32 outputs a harmonic amplitude distribution Da_n according to control data C_n including a harmonic frequency H_n, an amplitude spectrum envelope Ea, and a target feature X.

It is of note, however, that control data Cp_n are supplied to a second trained model 33 of the fifth embodiment. The control data Cp_n include a harmonic amplitude distribution Da_n generated by the first trained model 32 in addition to the same elements as those in the control data C_n in the first embodiment (the harmonic frequency H_n, the amplitude spectrum envelope Ea, and the target feature X). Specifically, the control data Cp_n corresponding to an n-th harmonic component in a unit period include a harmonic amplitude distribution Da_n, generated by the first trained model 32, for the unit period and the harmonic component. That is, the second trained model 33 of the fifth embodiment is a predictive statistical model by which some relations between control data Cp_n and harmonic phase distributions Dp_n have been learned, wherein the control data Cp_n includes a harmonic frequency H_n, an amplitude spectrum envelope Ea, a target feature X, and a harmonic amplitude distribution Da_n.

The same technical effects as those in the first embodiment can be attained in the fifth embodiment. In the fifth embodiment, control data Cp_n used for specifying a harmonic phase distribution Dp_n for each harmonic component include a harmonic amplitude distribution Da_n generated by the first trained model 32. Accordingly, it is possible to specify an appropriate harmonic phase distribution Dp_n that reflects a correlative tendency between a harmonic amplitude distribution Da_n and a harmonic phase distribution Dp_n in the teacher data. A configuration of calculating the phase spectrum envelope Ep from the amplitude spectrum envelope Ea in the second embodiment may be adopted in the fifth embodiment.

Sixth Embodiment

In the first to fifth embodiments, a harmonic frequency H_n in a single unit period is supplied to the first trained model 32 and the second trained model 33. Considering, however, a tendency that the harmonic frequency H_n changes with time within a sound period of a single note, a preferable configuration would be one in which the control data C_n for a unit period include a harmonic frequency H_n in the unit period and also harmonic frequencies H_n in unit periods immediately preceding and following the unit period. Thus, the control data C_n of the sixth embodiment represent temporal changes in the harmonic frequency H_n.

Specifically, the control data generator 31 in the sixth embodiment generates control data C_n for a t-th unit period such that the control data C_n include a harmonic frequency H_n for the t-th unit period, a harmonic frequency H_n for an immediately preceding (t−1)-th unit period, and a harmonic frequency H_n for an immediately following (t+1)-th unit period.

As will be understood from the above explanations, a tendency in temporal changes in the harmonic frequency H_n is reflected in the relations between control data C_n and harmonic amplitude distributions Da_n learned by the first trained model 32 of the sixth embodiment. Accordingly, it is possible to specify an appropriate harmonic amplitude distribution Da_n that reflects a tendency in temporal changes in the harmonic frequency H_n. Similarly, a tendency in temporal changes in the harmonic frequency H_n is reflected in the relations between control data C_n and harmonic phase distribution Dp_n learned by the second trained model 33 of the sixth embodiment. Accordingly, it is possible to specify an appropriate harmonic phase distribution Dp_n that reflects a tendency in temporal changes in the harmonic frequency H_n.

In the above explanation, the harmonic frequencies H_n in immediately preceding and immediately following unit periods are included in the control data C_n. However, a number of harmonic frequencies H_n that are included in the control data C_n can be changed as appropriate. For example, (i) either the harmonic frequency H_n in the immediately preceding (the (t−1)-th) unit period or one in the immediately following (the (t+1)-th) unit period, and (ii) the harmonic frequency H_n in the t-th unit period may be included in control data C_n. Harmonic frequencies H_n in multiple unit periods that precede the t-th unit period may be included in the control data C_n for the t-th unit period. Harmonic frequencies H_n in multiple unit periods that follow the t-th unit period may be included in the control data C_n for the t-th unit period.

Further, in the above description, the control data C_n for the t-th unit period include a harmonic frequency H_n for one or more other unit periods. However, the control data C_n may include an amount of change in harmonic frequency H_n (e.g., a time differential value of the frequency). For example, the control data C_n for the t-th unit period include an amount of change in harmonic frequency H_n between the (t−1)-th unit period and the t-th unit period, or an amount of change in harmonic frequency H_n between the t-th unit period and the (t+1)-th unit period.

As will be understood from the above explanations, control data C_n for an n-th harmonic component in a t-th unit period include:

(1) a harmonic frequency H_n of a harmonic component in the t-th unit period; and (2) a harmonic frequency H_n of a harmonic component in a unit period other than the t-th (typically, immediately preceding or immediately following unit period), or the amount of change in harmonic frequency H_n between the t-th period and a unit period that precede or follow the t-th unit period.

A configuration in one or more of the second to the fifth embodiments may be adopted in the sixth embodiment.

Seventh Embodiment

Figure 9:
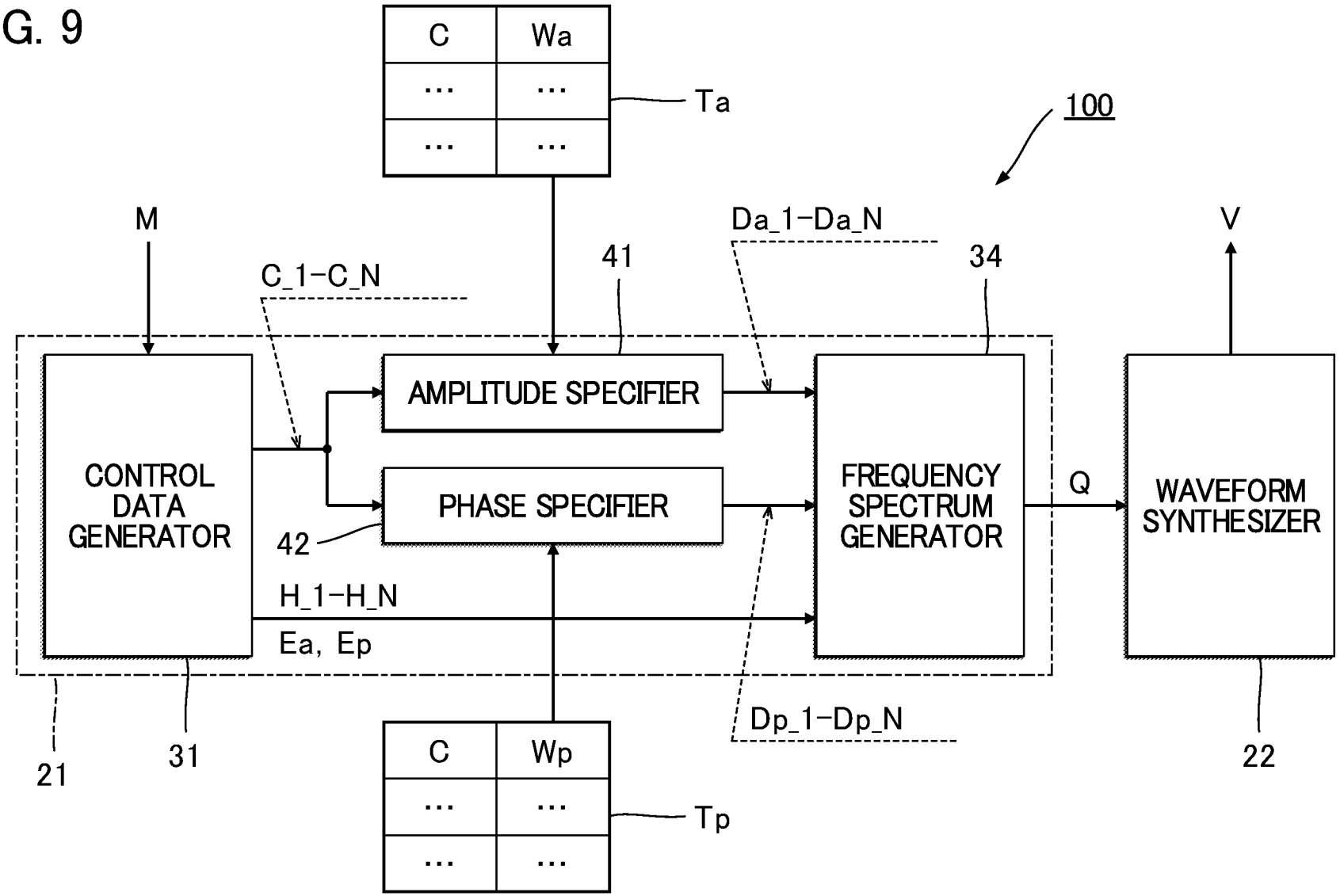
FIG. 9 is a block diagram illustrating a functional configuration of a voice synthesis apparatus according to a seventh embodiment.

FIG. 9 is a block diagram showing a functional configuration of the controller 11 in the seventh embodiment. As shown in FIG. 9, in the harmonic processor 21 in the seventh embodiment, the first trained model 32 in the first embodiment is replaced by an amplitude specifier 41 and the second trained model 33 in the first embodiment is replaced by a phase specifier 42. The processing of generating an amplitude spectrum envelope Ea, a phase spectrum envelope Ep, N portions of control data C_1 to C_N by the control data generator 31 is the same as that for the first embodiment.

The amplitude specifier 41 specifies a harmonic amplitude distribution Da_n in accordance with control data C_n generated by the control data generator 31. The amplitude specifier 41 outputs for each unit period N harmonic amplitude distributions Da_1 to Da_N respectively corresponding to the N portions of control data C_1 to C_N. The phase specifier 42 specifies a harmonic phase distribution Dp_n in accordance with the control data C_n generated by the control data generator 31. The phase specifier 42 outputs for each unit period N harmonic phase distributions Dp_1 to Dp_N respectively corresponding to N portions of control data C_1 to C_N.

The storage device 12 in the seventh embodiment has stored therein a reference table Ta that is used by the amplitude specifier 41 for specifying the harmonic amplitude distribution Da_n. The storage device 12 also has stored therein a reference table Tp that is used by the phase specifier 42 for specifying the harmonic phase distribution Dp_n. The reference table Ta and the reference table Tp may be stored separately in different recording media.

As shown in FIG. 9, the reference table Ta is a data table in which shape data Wa representative of a harmonic amplitude distribution Da in a unit band B is registered for each of different control data C that could be generated by the control data generator 31. The shapes of the harmonic amplitude distributions Da registered in the reference table Ta are different for various control data C. As will be understood from the above explanations, the storage device 12 according to the seventh embodiment has stored therein a harmonic amplitude distribution Da_n for each control data C (i.e., for a set of a harmonic frequency H_n, an amplitude spectrum envelope Ea, and a target feature X).

As shown in FIG. 9, the reference table Tp is a data table in which shape data Wp representative of a harmonic phase distribution Dp in a unit band B is registered for each of different control data C that could be generated by the control data generator 31. The shapes of the harmonic phase distributions Dp registered in the reference table Tp are different for various control data C. As will be understood from the above explanations, the storage device 12 according to the seventh embodiment has stored therein a harmonic phase distribution Dp_n for each control data C (i.e., for a set of a harmonic frequency H_n, an amplitude spectrum envelope Ea, and a target feature X). In FIG. 9 two separate tables, the reference table Ta and the reference table Tp, are provided. However, a single reference table which associates the control data C with the shape data Wa, and the shape data Wp may be used by the amplitude specifier 41 and the phase specifier 42.

The amplitude specifier 41 in FIG. 9 searches for shape data Wa that correspond to control data C_n generated by the control data generator 31, from among different shape data Wa registered in the reference table Ta, to output a harmonic amplitude distribution Da_n represented by the shape data Wa. That is, the amplitude specifier 41 obtains from the storage device 12 shape data Wa that correspond to control data C_n of each of N harmonic components, to specify a harmonic amplitude distribution Da_n for the harmonic component.

The phase specifier 42 searches for shape data Wp that correspond to control data C_n generated by the control data generator 31, from among different shape data Wp registered in the reference table Tp, to output a harmonic phase distribution Dp_n represented by the shape data Wp. That is, the phase specifier 42 obtains from the storage device 12 shape data Wp that correspond to control data C_n of each of N harmonic components, to specify a harmonic phase distribution Dp_n for the harmonic component. The frequency spectrum generator 34 generates a frequency spectrum Q of a voice to be synthesized based on the N harmonic amplitude distributions Da_1 to Da_N specified by the amplitude specifier 41, N harmonic phase distributions Dp_1 to Dp_N specified by the phase specifier 42, and the amplitude spectrum envelope Ea, and the phase spectrum envelope Ep. The frequency spectrum Q is generated for each unit period by use of the same configuration and method as those used in the first embodiment. Similarly to the first embodiment, the waveform synthesizer 22 generates a time-domain voice signal V based on a series of frequency spectra Q, each of which is generated for each unit period by the harmonic processor 21.

Figure 10:
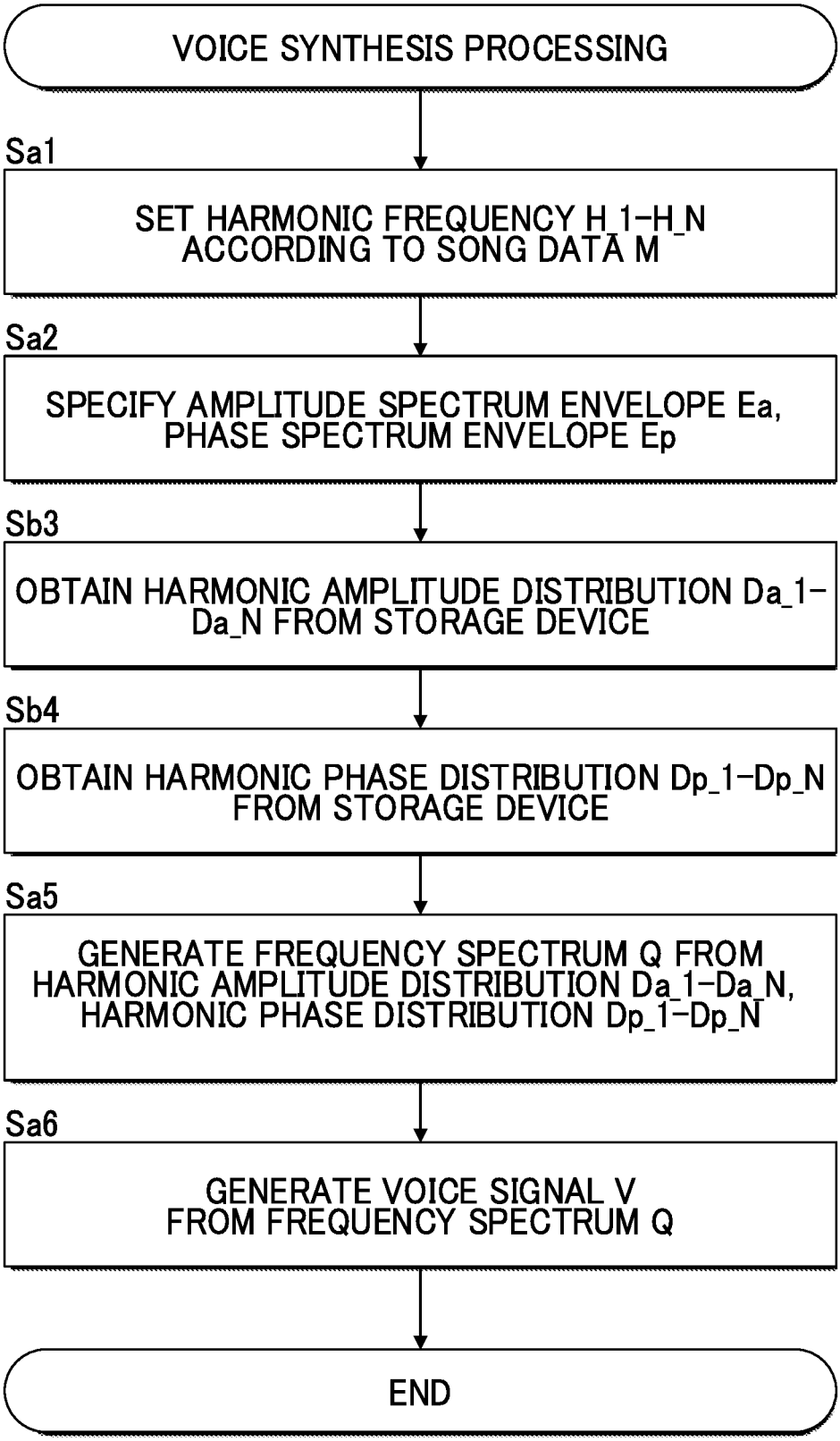
FIG. 10 is a flowchart of voice synthesis processing in the seventh embodiment.

FIG. 10 is a flowchart showing a flow of voice synthesis processing performed by the controller 11 of the seventh embodiment. The voice synthesis processing is initiated for example with an instruction from a user of the voice synthesis apparatus 100 acting as a trigger and repeated for each unit period.

When the voice synthesis processing starts, the control data generator 31 generates N portions of control data C_1 to C_N similarly to the first embodiment (Sa1, Sa2). The amplitude specifier 41 obtains, for each of the N harmonic components, shape data Wa (harmonic amplitude distribution Da_n) that correspond to the control data C_n (Sb3). The phase specifier 42 obtains, for each of the N harmonic components, shape data Wp (harmonic phase distribution Dp_n) that correspond to the control data C_n (Sb4). The step of obtaining the N harmonic amplitude distributions Da_1 to Da_N (Sb3) and the step of obtaining N harmonic phase distributions Dp_1 to Dp_N (Sb4) may be performed in reverse order. The frequency spectrum generator 34 generates a frequency spectrum Q in the same manner as in the first embodiment (Sa5); the waveform synthesizer 22 generates a voice signal V based on a series of frequency spectra Q in the same manner as in the first embodiment (Sa6).

As described, in the seventh embodiment, a harmonic amplitude distribution Da_n is specified based on a target feature X, a harmonic frequency H_n, and an amplitude spectrum envelope Ea. Thus, similarly to the first embodiment, it is possible to simplify processing of synthesizing a voice having a target feature X as compared to a technique as disclosed in Patent Document 1 in which a voice with neutral voice features is first synthesized and the voice with the neutral voice features is then converted into that with the target feature. Likewise, it is possible to synthesize a voice with a target feature X phase spectrum Qp of which is appropriate, similarly to the first embodiment, since a harmonic phase distribution Dp_n for each harmonic component is specified based on target feature X, a harmonic frequency H_n, and an amplitude spectrum envelope Ea.

Further, in the seventh embodiment, a harmonic amplitude distribution Da_n is specified by obtaining shape data Wa that correspond to the control data C_n for each harmonic component from the storage device 12 in which shape data Wa are stored in correspondence with control data C. Accordingly, machine learning for generating the first trained model 32 and computation for specifying a harmonic amplitude distribution Da_n using the first trained model 32, as described in first embodiment, are not required in the seventh embodiment. Likewise, a harmonic phase distribution Dp_n is specified by obtaining shape data Wp that correspond to the control data C_n for each harmonic component from the storage device 12 in which shape data Wp are stored in correspondence with control data C. Accordingly, machine learning for generating the second trained model 33 and computation for specifying a harmonic phase distribution Dp_n using the second trained model 33, as described in first embodiment, are not required in the seventh embodiment.

Eighth Embodiment

A voice synthesis apparatus 100 of the eighth embodiment has the same configuration as that in the seventh embodiment. As shown in the configuration shown in FIG. 9, a harmonic processor 21 in the eighth embodiment has a control data generator 31, an amplitude specifier 41, a phase specifier 42, and a frequency spectrum generator 34.

In the seventh embodiment, an example of a configuration is given in which there is stored in the storage device 12 shape data Wa for each control data C. However, there is a possibility that no shape data Wa that correspond to control data C_n generated by the control data generator 31 is stored in the storage device 12. Accordingly, in the eighth embodiment, a harmonic amplitude distribution Da_n is specified by interpolation between shape data Wa stored in the storage device 12 in a case in which shape data Wa for the control data C_n are not stored in the storage device 12. Specifically, in the eighth embodiment, the amplitude specifier 41 selects from the reference table Ta control data C_n in ascending order of distance to the control data C_n generated by the control data generator 31 and interpolates between shape data Wa that correspond to the control data C, to specify a harmonic amplitude distribution Da_n. A harmonic amplitude distribution Da_n may be specified by a weighted sum of the shape data Wa.

If a distance between the control data C_n generated by the control data generator 31 and control data C closest to the generated control data C_n is less than a predetermined threshold, the amplitude specifier 41 may specify a harmonic amplitude distribution Da_n represented by shape data Wa that correspond to the closest control data C. Thus, in a case in which control data C sufficiently close to the control data C_n are included in the reference table Ta, interpolation of shape data Wa is omitted.

The same processing is applied not only to amplitude, as focused on above, but also to phase. That is, a harmonic phase distribution Dp_n is specified by interpolation between shape data Wp stored in the storage device 12 in a case in which shape data Wp for the control data C_n are not stored in the storage device 12. Specifically, the phase specifier 42 in the eighth embodiment selects from the reference table Tp control data C_n in ascending order of distance to the control data C_n generated by the control data generator 31 and interpolates between shape data Wp that correspond to the control data C, to specify a harmonic phase distribution Dp_n.

If a distance between the control data C_n generated by the control data generator 31 and control data C closest to the generated control data C_n is less than a predetermined threshold, the phase specifier 42 may specify a harmonic phase distribution Dp_n represented by shape data Wp that correspond to the closest control data C. Thus, in a case in which control data C sufficiently close to the control data C_n are included in the reference table Tp, interpolation of shape data Wp is omitted. In a configuration in which there is used a reference table in which control data C, shape data Wa, and shape data Wp correspond, a single search for control data C closest to the control data C_n is performed for the amplitude specifier 41 and the phase specifier 42, rather than the search being separately performed by each of the amplitude specifier 41 and the phase specifier 42.

The same technical effects as those in the seventh embodiment are attainable in the eighth embodiment. Additionally, in the eighth embodiment, it is possible to reduce a number of shape data Wa stored in the storage device 12 since a harmonic amplitude distribution Da_n for each harmonic component is specified by interpolation between shape data Wa stored in the storage device 12. Likewise, it is possible to reduce a number of shape data Wp stored in the storage device 12 since a harmonic phase distribution Dp_n for each harmonic component is specified by interpolation between shape data Wp stored in the storage device 12.

Ninth Embodiment

The voice synthesis apparatus 100 according to the ninth embodiment has the same configuration as that of the seventh embodiment. As in the configuration shown in FIG. 9, a harmonic processor 21 in the ninth embodiment has a control data generator 31, an amplitude specifier 41, a phase specifier 42, and a frequency spectrum generator 34. In the ninth embodiment, however, the amplitude specifier 41 specifies a harmonic amplitude distribution Da_n for each harmonic component in a manner different from that in the seventh embodiment.

Figure 11:
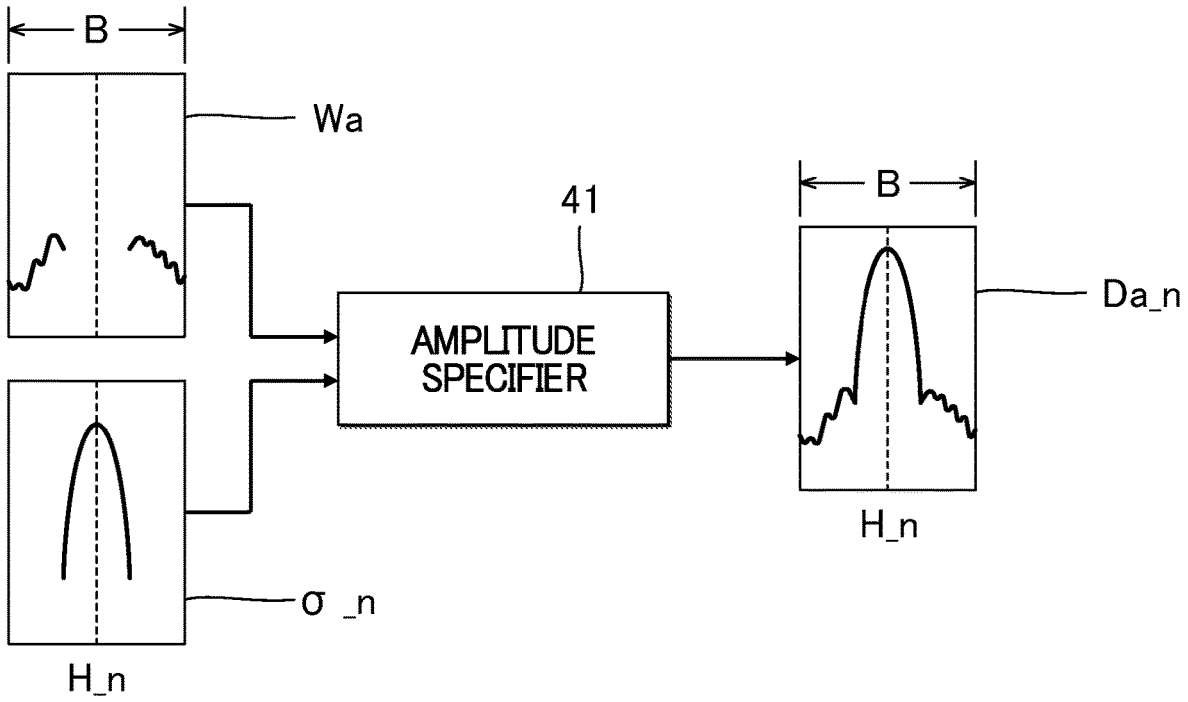
FIG. 11 is an explanatory diagram of an amplitude specifier in a ninth embodiment.

FIG. 11 is an explanatory diagram of an operation performed by the amplitude specifier 41 in the ninth embodiment. As shown in FIG. 11, shape data Wa stored in the storage device 12 of the ninth embodiment are representative of an amplitude distribution of a non-harmonic component in a unit band B. In other words, an amplitude distribution represented by the shape data Wa does not include an amplitude peak for a harmonic component. In the same manner as in the seventh embodiment, the amplitude specifier 41 obtains from the storage device 12 shape data Wa that correspond to control data C_n generated by the control data generator 31.

As shown in FIG. 11, the amplitude specifier 41 adds an amplitude peak component σ_n to the shape data Wa obtained for the n-th harmonic component, to generate a harmonic amplitude distribution Da_n for the harmonic component. The amplitude peak component σ_n may be an amplitude distribution corresponding to a periodic function (e.g., a sine wave) of a harmonic frequency H_n. A harmonic amplitude distribution Dan is specified by synthesizing the amplitude peak component σ_n onto an amplitude distribution of a non-harmonic component represented by the shape data Wa. As will be understood from the above explanations, an amplitude distribution represented by the shape data Wa has a shape obtained by removing an amplitude peak component σ_n from the harmonic amplitude distribution Da.

N harmonic amplitude distributions Da_1 to Da_N that respectively correspond to N harmonic components are specified for each unit period. The frequency spectrum generator 34 generates a frequency spectrum Q based on the N harmonic amplitude distributions Da_1 to Da_N specified by the amplitude specifier 41 and the N harmonic phase distributions Dp_1 to Dp_N specified by the phase specifier 42 in the same manner as in the first embodiment.

The same technical effects as those in the seventh embodiment are attainable in the ninth embodiment. In the ninth embodiment, since a harmonic amplitude distribution Da_n is specified by adding an amplitude peak component σ_n to shape data Wa, it is possible to reduce an amount of the shape data Wa as compared with a configuration in which shape data Wa are representative of an amplitude distribution on both a harmonic component (amplitude peak component σ_n) and a non-harmonic component.

Modifications

Specific modifications added to each of the aspects described above are described below. Two or more modes selected from the following descriptions may be combined with one another as appropriate in so far as no contradiction arises.

(1) Two or more embodiments selected from the first to ninth embodiments may be combined. For example, the configuration of the second embodiment in which a phase spectrum envelope Ep is calculated from the amplitude spectrum envelope Ea may be applied to any of the seventh to the ninth embodiments. Further, the configuration of the third embodiment in which a harmonic amplitude distribution Da_n for the (t−1)-th unit period (an example of the second unit period) is included in control data Ca_n for the t-th unit period may be applied to any of the seventh to the ninth embodiments. The configuration of the fourth embodiment in which control data Ca_n include a harmonic amplitude distribution Da_n−1 for another harmonic component may be applied to any of the seventh to the ninth embodiments. The configuration of the fifth embodiment in which control data Cp_n include a harmonic amplitude distribution Da_n may be applied to any of the seventh to the ninth embodiments.

The first and seventh embodiments may be combined. The first trained model 32 in the first embodiment may be used to specify a harmonic amplitude distribution Da_n and the phase specifier 42 in the seventh embodiment may be used to specify a harmonic phase distribution Dp_n in one configuration. In another configuration, the amplitude specifier 41 in the seventh embodiment may be used to specify a harmonic amplitude distribution Da_n, and the second trained model 33 in the first embodiment may be used to specify a harmonic phase distribution Dp_n.

(2) In the second embodiment, a minimum phase calculated from the amplitude spectrum envelope Ea is used as a phase spectrum envelope Ep. It is of note, however, that the phase spectrum envelope Ep is not limited to a minimum phase. The frequency differentiation of the amplitude spectrum envelope Ea may be used as a phase spectrum envelope Ep. A series of numerical values that do not depend on an amplitude spectrum envelope Ea (e.g., a series of predetermined values across all the frequencies) may be used as a phase spectrum envelope Ep. It is of note that a vocoder, such as WaveNet, can be used to generate a voice signal V based on an amplitude spectrum Qa defined by an amplitude spectrum envelope Ea and N harmonic amplitude distributions Da_1 to Da_N. Accordingly, a phase spectrum Qp and a phase spectrum envelope Ep are not necessarily used in generation of the voice signal V.

(3) In the fourth embodiment, control data Ca_n corresponding to an n-th harmonic component include a harmonic amplitude distribution Da_n−1 in a harmonic component that is in a lower frequency range of the n-th harmonic component. However, a harmonic amplitude distribution Da_n+1 specified for a harmonic component that is in a higher frequency range of the n-th harmonic component may be included in the control data Ca_n.

(4) The voice synthesis apparatus 100 may be realized by a server apparatus that communicates with a terminal apparatus (e.g., a portable telephone or a smartphone) via a communication network, such as a mobile communication network or the Internet. Specifically, the voice synthesis apparatus 100 generates a voice signal V by performing voice synthesis processing (FIG. 4 or FIG. 10) based on song data M received from the terminal apparatus, and transmits the generated voice signal V to the terminal apparatus. The sound output device of the terminal apparatus outputs a voice represented by the voice signal V received from the voice synthesis apparatus 100. Alternatively, a frequency spectrum Q generated by the frequency spectrum generator 34 of the voice synthesis apparatus 100 may be transmitted to the terminal apparatus, and the waveform synthesizer 22 provided in the terminal apparatus may generate a voice signal V based on the frequency spectrum Q. Accordingly, the waveform synthesizer 22 may be omitted from the voice synthesis apparatus 100. Still alternatively, control data C_n and control data Cp_n generated by the control data generator 31 provided at the terminal apparatus may be transmitted to the voice synthesis apparatus 100, and the voice synthesis apparatus 100 may transmit to the terminal apparatus a voice signal V (or a frequency spectrum Q) generated based on the control data C_n and control data Cp_n received from the terminal apparatus. Accordingly, the control data generator 31 may be omitted from the voice synthesis apparatus 100.

(5) Preferred modes of the present disclosure can be used for synthesizing any type of sound. For example, the preferred modes of the present disclosure may be used to synthesize various types of sounds, such as natural, electronic, or electric musical instrument sounds, a sound produced by living things (e.g., calls of animals or insects), or sound effects.

(6) The voice synthesis apparatus 100 according to the embodiments described above are realized by coordination between a computer (specifically, the controller 11) and a computer program as described in the embodiments. The computer program according to each of the described embodiments may be provided in a form readable by a computer and stored in a recording medium, and installed in the computer. The recording medium is, for example, a non-transitory recording medium. While an optical recording medium (an optical disk) such as a CD-ROM (Compact disk read-only memory) is a preferred example of a recording medium, the recording medium may also include a recording medium of any known form, such as a semiconductor recording medium or a magnetic recording medium. The non-transitory recording medium includes any recording medium except for a transitory, propagating signal, and does not exclude a volatile recording medium. The computer program may be provided to a computer in a form of distribution via a communication network.

(7) Each of the trained models (the first trained model 32 and the second trained model 33) is realized by a combination of a computer program (for example, a program module constituting artificial-intelligence software) that causes the controller 11 to perform an operation to specify output B based on input A, and coefficients applied to the operation. The coefficients of the trained model are optimized by prior machine learning (deep learning) by using teacher data in which input A and output B are associated with each other. That is, a trained model is a statistical model by which some relations between input A and output B have been learned. The controller 11 performs, on an unknown input A, the operation to which the trained coefficients and a predetermined response function are applied, thereby generating output B adequate for the input A in accordance with a tendency (the relations between input A and output B) extracted from the teacher data. The subject that executes Artificial Intelligence software is not limited to a CPU. A processor circuit for an NN, such as a tensor processing unit and a neural engine, or a DSP (Digital Signal Processor) for signal processing may execute the Artificial Intelligence software. Plural types of processor circuits selected from the above examples may work cooperatively to execute the Artificial Intelligence software.

(8) The following configurations, for example, are derivable from the embodiments described above.

A voice synthesis method according to a preferred aspect (a first aspect) of the present disclosure designates a target feature of a voice to be synthesized; specifies harmonic frequencies for a plurality of respective harmonic components of the voice and an amplitude spectrum envelope of the voice; specifies a harmonic amplitude distribution of each of the plurality of respective harmonic components based on (i) the target feature, (ii) the amplitude spectrum envelope, and (iii) the harmonic frequency specified for the respective harmonic component, the harmonic amplitude distribution representing a distribution of amplitudes in a unit band with a peak amplitude corresponding to the respective harmonic component; and generates a frequency spectrum of the voice with the target feature based on harmonic amplitude distributions specified for each of the plurality of respective harmonic components and the amplitude spectrum envelope. In this aspect, a harmonic amplitude distribution for each of harmonic components is specified for each of the harmonic components based on a target feature, an amplitude spectrum envelope, and a harmonic frequency, and a frequency spectrum of a voice having the target feature is generated from harmonic amplitude distributions. Accordingly, it is possible to simplify synthesis processing as compared to a technique as disclosed in Patent Document 1 in which a voice with neutral voice features is first synthesized and the voice with the neutral voice features is then converted into one with the target feature.

In a preferred example (a second aspect) of the first aspect, the specifying the harmonic amplitude distribution of each of the plurality of respective harmonic components includes specifying the harmonic amplitude distribution of each of the plurality of respective harmonic components, using a first trained model by which relations between first control data and harmonic amplitude distributions have been learned, the first control data including the target feature, a harmonic frequency of the respective harmonic component, and the amplitude spectrum envelope. In this aspect, a harmonic amplitude distribution of each harmonic component is specified by the first trained model in which relations are learned between first control data and harmonic amplitude distributions, the first control data including a target feature, a harmonic frequency, and an amplitude spectrum envelope. Accordingly, it is possible to appropriately specify a harmonic amplitude distribution corresponding to unknown control data as compared with a configuration in which a reference table in which there are associated first control data and harmonic amplitude distributions is provided to specify a harmonic amplitude distribution.

In a preferred example (a third aspect) of the second aspect, the specifying the harmonic amplitude distribution of each of the plurality of respective harmonic components includes specifying the harmonic amplitude distribution of each of the plurality of respective harmonic components for each of a first unit period and a second unit period that immediately precedes the first unit period, and the first control data, which is provided to specify a harmonic amplitude distribution for each harmonic component of the plurality of respective harmonic components in the first unit period, further includes a harmonic amplitude distribution specified for a corresponding harmonic component in the second unit period. In this aspect, since the first control data in the first unit period include a harmonic amplitude distribution specified in the immediately preceding second unit period, it is possible to specify a series of appropriate harmonic amplitude distributions that reflect a tendency in the temporal changes in harmonic amplitude distribution corresponding to harmonic components.

In a preferred example (a fourth aspect) of the second aspect or the third aspect, the plurality of respective harmonic components include a first harmonic component and a second harmonic component that is adjacent the first harmonic component on a frequency axis, and the first control data provided to specify a harmonic amplitude distribution for the first harmonic component includes a harmonic amplitude distribution specified for the second harmonic component. In this aspect, since the first control data provided for specifying a harmonic amplitude distribution in a first harmonic component include a harmonic amplitude distribution specified for a second harmonic component that is adjacent the first harmonic component on a frequency axis, it is possible to specify an appropriate harmonic amplitude distribution that reflects a correlative tendency between harmonic components adjacent each other on the frequency axis.

In a preferred example (a fifth aspect) of the second aspect, the specifying the harmonic amplitude distribution of each of the plurality of respective harmonic components includes specifying harmonic amplitude distributions of each of the plurality of respective harmonic components for a plurality of unit periods, and the first control data, provided to specify a harmonic amplitude distribution for each of a plurality of harmonic components in a first unit period from among the plurality of unit periods, includes (i) a harmonic frequency for each of the plurality of harmonic components in the first unit period and (ii) a harmonic frequency of a corresponding harmonic component in a second unit period other than the first unit period, or an amount of change in harmonic frequency for the corresponding harmonic component between the first unit period and the second unit period, which precedes or follows the first unit period. In this aspect, it is possible to specify an appropriate harmonic amplitude distribution that reflects a tendency in the temporal changes in harmonic amplitude distribution.

In a preferred example (a sixth aspect) of any one of the second to the fifth aspect, the voice synthesis method further includes specifying a harmonic phase distribution of each of the plurality of respective harmonic components based on (i) the target feature, (ii) the amplitude spectrum envelope, and (iii) the harmonic frequency of the respective harmonic component, the harmonic phase distribution being a distribution of phases in the unit band, wherein the generating the frequency spectrum includes generating the frequency spectrum of the voice having the target feature based on (i) the amplitude spectrum envelope, (ii) a phase spectrum envelope, (iii) the harmonic amplitude distributions specified for each of the plurality of respective harmonic components, and (iv) harmonic phase distributions specified for each of the plurality of respective harmonic components. In this aspect, a harmonic phase distribution for each of the harmonic components is specified based on the target feature, the amplitude spectrum envelope, and a harmonic frequency for each harmonic component, and a frequency spectrum of the voice having the target feature is generated from the harmonic amplitude distributions and harmonic phase distributions. Accordingly, it is possible to synthesize a voice having a target feature and with an appropriate phase spectrum.

In a preferred example (a seventh aspect) of the sixth aspect, the specifying the harmonic phase distribution of each of the plurality of respective harmonic components includes specifying the harmonic phase distribution of each of the plurality of respective harmonic components, using a second trained model by which relations between second control data and harmonic phase distributions have been learned, the second control data including the target feature, a harmonic frequency of the respective harmonic component, and the amplitude spectrum envelope. In this aspect, a harmonic phase distribution is specified by a second trained model in which relations are learned between second control data and harmonic phase distributions, the second control data including a target feature, a harmonic frequency, and an amplitude spectrum envelope. Accordingly, it is possible to appropriately specify a harmonic phase distribution corresponding to unknown first control data, as compared with a configuration in which a reference table in which there are associated first control data and harmonic phase distributions is provided to specify a harmonic phase distribution.

In a preferred example (an eighth aspect) of the seventh aspect, the specifying the harmonic phase distribution of each of the plurality of respective harmonic components includes supplying the second trained model with (i) the target feature, (ii) the harmonic frequency of the respective harmonic component, (iii) the amplitude spectrum envelope, and (iv) the harmonic amplitude distribution specified for each of the plurality of respective harmonic components by the first trained model, to specify the harmonic phase distribution of each of the plurality of respective harmonic components. According to the above aspect, it is possible to specify an appropriate harmonic phase distribution that reflects a correlative tendency between harmonic amplitude distributions and harmonic phase distributions.

In a preferred example (a ninth aspect) of any one of the sixth to the eighth aspects, the method further calculates the phase spectrum envelope from the amplitude spectrum envelope. In this aspect, since a phase spectrum envelope is calculated from an amplitude spectrum envelope, it is possible to simplify processing for generating a phase spectrum envelope.

In a preferred example (tenth aspect) of the first aspect, the specifying the harmonic amplitude distribution of each of the plurality of respective harmonic components includes obtaining, for each of the plurality of respective harmonic components, shape data corresponding to control data from a storage device, and specifying, based on the obtained shape data, the harmonic amplitude distribution of the respective harmonic component, wherein the storage device stores therein shape data representative of a distribution of amplitudes in the unit band in association with portions of control data each including the target feature, a harmonic frequency of the respective harmonic component, and the amplitude spectrum envelope. In this aspect, control data are specified by obtaining shape data that correspond to control data of each harmonic component from a storage device in which there are stored shape data in association with control data. Accordingly, it is possible to easily specify a harmonic amplitude distribution corresponding to control data.

In a preferred example (an eleventh aspect) of the tenth aspect, the specifying the harmonic amplitude distribution of each of the plurality of respective harmonic components includes specifying a harmonic amplitude distribution of each of the plurality of respective harmonic components by interpolation between plural portions of shape data stored in the storage device. In this aspect, since a harmonic amplitude distribution for each harmonic component is specified by interpolation between shape data stored in the storage device, it is possible to reduce an amount of shape data stored in the storage device.

In a preferred example (a twelfth aspect) of the tenth aspect, the shape data are representative of an amplitude distribution of a non-harmonic component in the unit band, and the specifying the harmonic amplitude distribution of each of the plurality of respective harmonic components includes adding, to the shape data obtained from the storage device for each of the plurality of respective harmonic components, an amplitude peak component that corresponds to the harmonic frequency of each of the plurality of respective harmonic components, to generate the harmonic amplitude distribution of each of the plurality of respective harmonic components. In this aspect, since a harmonic amplitude distribution is specified by adding an amplitude peak component to shape data, it is possible to reduce an amount of shape data.

In a preferred example (a thirteenth aspect) of any one of the first to the twelfth aspects, the harmonic amplitude distribution of each of the plurality of respective harmonic components represents a distribution of amplitude values relative to a typical amplitude that corresponds to each of the plurality of respective harmonic components. In this aspect, since a harmonic amplitude distribution is a distribution of amplitude values relative to the typical amplitude, it is possible to generate an appropriate frequency spectrum regardless of whether the typical amplitude is high or low.

A voice synthesis apparatus according to a preferred aspect (a fourteenth aspect) of the present disclosure is a voice synthesis apparatus that includes a memory; and at least one processor, and the at least one processor, by execution of instructions stored in the memory, is configured to: designate a target feature of a voice to be synthesized; specify harmonic frequencies for a plurality of respective harmonic components of the voice and an amplitude spectrum envelope of the voice; specify a harmonic amplitude distribution for each of the plurality of respective harmonic components based on (i) the target feature, (ii) the amplitude spectrum envelope, and (iii) the harmonic frequency specified for the respective harmonic component, the harmonic amplitude distribution representing a distribution of amplitudes in a unit band with a peak amplitude corresponding to the respective harmonic component; and generate a frequency spectrum of the voice with the target feature based on harmonic amplitude distributions specified for each of the plurality of respective harmonic components and the amplitude spectrum envelope In this aspect, a harmonic amplitude distribution for each harmonic component is specified based on a target feature, an amplitude spectrum envelope, and a harmonic frequency in the harmonic component, and a frequency spectrum of a voice having the target feature is generated from the harmonic amplitude distributions. Accordingly, it is possible to simplify synthesis processing as compared to a technique as disclosed in Patent Document 1 in which a voice with neutral voice features is first synthesized and the voice with the neutral voice features is then converted into one with the target feature.

A recording medium according to a preferred aspect (a fifteenth aspect) of the present disclosure is a computer-readable recording medium having stored therein a computer program for causing a computer to execute: A non-transitory computer-readable recording medium having stored therein a computer program for causing a computer to perform a voice synthesis method of: designating a target feature of a voice to be synthesized; specifying harmonic frequencies for a plurality of respective harmonic components of the voice and an amplitude spectrum envelope of the voice; specifying a harmonic amplitude distribution of each of the plurality of respective harmonic components based on (i) the target feature, (ii) the amplitude spectrum envelope, and (iii) the harmonic frequency specified for the respective harmonic component, the harmonic amplitude distribution representing a distribution of amplitudes in a unit band with a peak amplitude corresponding to the respective harmonic component (e.g., Step Sa3 in FIG. 4 or Step Sb3 in FIG. 10); and generating a frequency spectrum of the voice with the target feature based on harmonic amplitude distributions specified for each of the plurality of respective harmonic components and the amplitude spectrum envelope (e.g., Step Sa6 in FIG. 4 or FIG. 10). In this aspect, a harmonic amplitude distribution for each harmonic component is specified based on a target feature, an amplitude spectrum envelope, and a harmonic frequency in the harmonic component, and a frequency spectrum of a voice having the target feature is generated from the harmonic amplitude distributions. Accordingly, it is possible to simplify synthesis processing as compared to a technique as disclosed in Patent Document 1 in which a voice with neutral voice features is first synthesized and the voice with the neutral voice features is then converted into one with the target feature.

DESCRIPTION OF REFERENCE SIGNS

100 . . . voice synthesis apparatus, 11 . . . controller, 12 . . . storage device, 13 . . . sound output device, 21 . . . harmonic processor, 22 . . . waveform synthesizer, 31 . . . control data generator 311 . . . phase calculator, 32 . . . first trained model, 33 . . . second trained model, 34 . . . frequency spectrum generator, 41 . . . amplitude specifier, 42 . . . phase specifier.

What is claimed is:

1. A computer-implemented voice synthesis method comprising:

designating a target feature of a voice to be synthesized;

specifying harmonic frequencies for a plurality of respective harmonic components of the voice and an amplitude spectrum envelope of the voice;

specifying a harmonic amplitude distribution of each of the plurality of respective harmonic components based on (i) the target feature, (ii) the amplitude spectrum envelope, and (iii) the harmonic frequency specified for the respective harmonic component, the harmonic amplitude distribution representing a distribution of amplitudes in a unit band with a peak amplitude corresponding to the respective harmonic component; and generating a frequency spectrum of the voice with the target feature based on harmonic amplitude distributions specified for each of the plurality of respective harmonic components and the amplitude spectrum envelope.

2. The computer-implemented voice synthesis method according to claim 1, wherein the specifying the harmonic amplitude distribution of each of the plurality of respective harmonic components includes specifying the harmonic amplitude distribution of each of the plurality of respective harmonic components, using a first trained model by which relations between first control data and harmonic amplitude distributions have been learned, the first control data including the target feature, a harmonic frequency of the respective harmonic component, and the amplitude spectrum envelope.

3. The computer-implemented voice synthesis method according to claim 2, wherein:

the specifying the harmonic amplitude distribution of each of the plurality of respective harmonic components includes specifying the harmonic amplitude distribution of each of the plurality of respective harmonic components for each of a first unit period and a second unit period that immediately precedes the first unit period, and the first control data, which is provided to specify a harmonic amplitude distribution for each harmonic component of the plurality of respective harmonic components in the first unit period, further includes a harmonic amplitude distribution specified for a corresponding harmonic component in the second unit period.

4. The computer-implemented voice synthesis method according to claim 2, wherein the plurality of respective harmonic components include a first harmonic component and a second harmonic component that is adjacent the first harmonic component on a frequency axis, and the first control data provided to specify a harmonic amplitude distribution for the first harmonic component includes a harmonic amplitude distribution specified for the second harmonic component.

5. The computer-implemented voice synthesis method according to claim 2, wherein:

the specifying the harmonic amplitude distribution of each of the plurality of respective harmonic components includes specifying harmonic amplitude distributions of each of the plurality of respective harmonic components for a plurality of unit periods, and the first control data, provided to specify a harmonic amplitude distribution for each of a plurality of harmonic components in a first unit period from among the plurality of unit periods, includes (i) a harmonic frequency for each of the plurality of harmonic components in the first unit period and (ii) a harmonic frequency of a corresponding harmonic component in a second unit period other than the first unit period, or an amount of change in harmonic frequency for the corresponding harmonic component between the first unit period and the second unit period, which precedes or follows the first unit period.

6. The computer-implemented voice synthesis method according to claim 2, further comprising specifying a harmonic phase distribution of each of the plurality of respective harmonic components based on (i) the target feature, (ii) the amplitude spectrum envelope, and (iii) the harmonic frequency of the respective harmonic component, the harmonic phase distribution being a distribution of phases in the unit band, wherein the generating the frequency spectrum includes generating the frequency spectrum of the voice having the target feature based on (i) the amplitude spectrum envelope, (ii) a phase spectrum envelope, (iii) the harmonic amplitude distributions specified for each of the plurality of respective harmonic components, and (iv) harmonic phase distributions specified for each of the plurality of respective harmonic components.

7. The computer-implemented voice synthesis method according to claim 6, wherein the specifying the harmonic phase distribution of each of the plurality of respective harmonic components includes specifying the harmonic phase distribution of each of the plurality of respective harmonic components, using a second trained model by which relations between second control data and harmonic phase distributions have been learned, the second control data including the target feature, a harmonic frequency of the respective harmonic component, and the amplitude spectrum envelope.

8. The computer-implemented voice synthesis method according to claim 7, wherein the specifying the harmonic phase distribution of each of the plurality of respective harmonic components includes supplying the second trained model with (i) the target feature, (ii) the harmonic frequency of the respective harmonic component, (iii) the amplitude spectrum envelope, and (iv) the harmonic amplitude distribution specified for each of the plurality of respective harmonic components by the first trained model, to specify the harmonic phase distribution of each of the plurality of respective harmonic components.

9. The computer-implemented voice synthesis method according to claim 6, further comprising calculating the phase spectrum envelope from the amplitude spectrum envelope.

10. The computer-implemented voice synthesis method according to claim 1, wherein the specifying the harmonic amplitude distribution of each of the plurality of respective harmonic components includes obtaining, for each of the plurality of respective harmonic components, shape data corresponding to control data from a storage device, and specifying, based on the obtained shape data, the harmonic amplitude distribution of the respective harmonic component, wherein the storage device stores therein shape data representative of a distribution of amplitudes in the unit band in association with portions of control data each including the target feature, a harmonic frequency of the respective harmonic component, and the amplitude spectrum envelope.

11. The computer-implemented voice synthesis method according to claim 10, wherein the specifying the harmonic amplitude distribution of each of the plurality of respective harmonic components includes specifying a harmonic amplitude distribution of each of the plurality of respective harmonic components by interpolation between plural portions of shape data stored in the storage device.

12. The computer-implemented voice synthesis method according to claim 10, wherein:

the shape data are representative of an amplitude distribution of a non-harmonic component in the unit band, and the specifying the harmonic amplitude distribution of each of the plurality of respective harmonic components includes adding, to the shape data obtained from the storage device for each of the plurality of respective harmonic components, an amplitude peak component that corresponds to the harmonic frequency of each of the plurality of respective harmonic components, to generate the harmonic amplitude distribution of each of the plurality of respective harmonic components.

13. The computer-implemented voice synthesis method according to claim 1, wherein the harmonic amplitude distribution of each of the plurality of respective harmonic components represents a distribution of amplitude values relative to a typical amplitude that corresponds to each of the plurality of respective harmonic components.

14. A voice synthesis apparatus comprising:

a memory; and at least one processor, wherein the at least one processor, by execution of instructions stored in the memory, is configured to:

designate a target feature of a voice to be synthesized;

specify harmonic frequencies for a plurality of respective harmonic components of the voice and an amplitude spectrum envelope of the voice;

specify a harmonic amplitude distribution for each of the plurality of respective harmonic components based on (i) the target feature, (ii) the amplitude spectrum envelope, and (iii) the harmonic frequency specified for the respective harmonic component, the harmonic amplitude distribution representing a distribution of amplitudes in a unit band with a peak amplitude corresponding to the respective harmonic component; and generate a frequency spectrum of the voice with the target feature based on harmonic amplitude distributions specified for each of the plurality of respective harmonic components and the amplitude spectrum envelope.

15. A non-transitory computer-readable recording medium having stored therein a computer program for causing a computer to perform a voice synthesis method of:

designating a target feature of a voice to be synthesized;

specifying harmonic frequencies for a plurality of respective harmonic components of the voice and an amplitude spectrum envelope of the voice;

specifying a harmonic amplitude distribution of each of the plurality of respective harmonic components based on (i) the target feature, (ii) the amplitude spectrum envelope, and (iii) the harmonic frequency specified for the respective harmonic component, the harmonic amplitude distribution representing a distribution of amplitudes in a unit band with a peak amplitude corresponding to the respective harmonic component; and generating a frequency spectrum of the voice with the target feature based on harmonic amplitude distributions specified for each of the plurality of respective harmonic components and the amplitude spectrum envelope.

* * * * *